US007033721B2

(12) United States Patent
Hashizume et al.

(10) Patent No.: US 7,033,721 B2
(45) **Date of Patent: *Apr. 25, 2006**

(54) METHOD FOR PRODUCING ELECTROPHOTOGRAPHIC PHOTOSENSITIVE MEMBER, ELECTROPHOTOGRAPHIC PHOTOSENSITIVE MEMBER AND ELECTROPHOTOGRAPHIC APPARATUS USING THE SAME

(75) Inventors: Junichiro Hashizume, Shizuoka (JP); Toshiyuki Ehara, Kanagawa (JP); Hideaki Matsuoka, Shizuoka (JP); Ryuji Okamura, Shizuoka (JP); Koji Hitsuishi, Shizuoka (JP); Satoshi Kojima, Shizuoka (JP); Hironori Ohwaki, Shizuoka (JP); Kazuto Hosoi, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 108 days.

This patent is subject to a terminal disclaimer.

(21) Appl. No.: 10/630,727

(22) Filed: Jul. 31, 2003

(65) Prior Publication Data

US 2004/0071890 A1 Apr. 15, 2004

(30) Foreign Application Priority Data

| | | |
|---|---|---|
| Aug. 2, 2002 | (JP) | 2002-226261 |
| Aug. 2, 2002 | (JP) | 2002-226262 |
| Aug. 2, 2002 | (JP) | 2002-226263 |
| Aug. 9, 2002 | (JP) | 2002-234186 |

(51) Int. Cl.
*G03G 5/082* (2006.01)
*C23C 16/22* (2006.01)

(52) U.S. Cl. ..... 430/128; 427/248.1; 428/446

(58) Field of Classification Search ..... 430/57.4, 430/57.7, 66, 67, 128; 427/248.1; 428/446
See application file for complete search history.

(56) References Cited

U.S. PATENT DOCUMENTS 4,265,991 A 5/1981 Hirai et al. ..... 430/64

(Continued)

FOREIGN PATENT DOCUMENTS

EP 1 229 394 A2 8/2002

(Continued)

*Primary Examiner*—John L Goodrow
(74) *Attorney, Agent, or Firm*—Fitzpatrick, Cella, Harper & Scinto

(57) ABSTRACT

The invention provides a method for producing an electrophotographic photosensitive member such that even if abnormal grown portions called spherical protrusions 203 exist on the surface of the photosensitive member, they do not appear on images, thus making it possible to considerably alleviate image defects. The method for producing the electrophotographic photosensitive member including layers each constituted by a non-single crystal material includes the steps of placing a substrate having a conductive surface in a film forming apparatus capable of being airtight-sealed under vacuum having evacuating means and raw material gas supplying means, and decomposing at least a raw material gas by a high frequency power to form a first layer constituted by at least a non-single crystal material on the substrate as a first step; exposing the substrate with the first layer formed thereon to a gas containing oxygen and water vapor as a second step; and decomposing at least a raw material gas by a high frequency power in the film forming apparatus to form on the first layer a second layer including an upper blocking layer constituted by a non-single crystal material as a third step.

26 Claims, 8 Drawing Sheets

U.S. PATENT DOCUMENTS

| | | | | |
|---|---|---|---|---|
| 4,451,547 | A | 5/1984 | Hirai et al. | 430/128 |
| 4,507,375 | A | 3/1985 | Hirai et al. | 430/128 |
| 4,552,824 | A | 11/1985 | Hirai et al. | 430/64 |
| 5,314,780 | A | 5/1994 | Takei et al. | 430/128 |
| 5,455,138 | A | 10/1995 | Okamura et al. | 430/128 |
| 5,480,627 | A | 1/1996 | Takei et al. | 430/127 |
| 5,576,060 | A | 11/1996 | Hirai et al. | 427/255.2 |
| 6,001,521 | A | 12/1999 | Hashizume et al. | 430/58.1 |
| 6,090,513 | A | 7/2000 | Niino et al. | 430/65 |
| 6,534,228 | B1 | 3/2003 | Kawada et al. | 430/66 |
| 6,635,397 | B1 * | 10/2003 | Okamura et al. | 430/65 |
| 6,846,600 | B1 * | 1/2005 | Ehara et al. | 430/66 |
| 2002/0168859 | A1 | 11/2002 | Ehara et al. | 438/694 |

FOREIGN PATENT DOCUMENTS

| | | |
|---|---|---|
| JP | 54-86341 | 7/1979 |
| JP | 64-86149 | 3/1989 |
| JP | 4-191748 | 7/1992 |
| JP | 7-64312 | 3/1995 |
| JP | 8-15882 | 1/1996 |
| JP | 2786756 | 5/1998 |
| JP | 11-133640 | 5/1999 |
| JP | 11-133641 | 5/1999 |

* cited by examiner

METHOD FOR PRODUCING ELECTROPHOTOGRAPHIC PHOTOSENSITIVE MEMBER, ELECTROPHOTOGRAPHIC PHOTOSENSITIVE MEMBER AND ELECTROPHOTOGRAPHIC APPARATUS USING THE SAME

BACKGROUND OF THE INVENTION

1. Field of the Invention

The present invention relates to a method for producing inexpensively an amorphous silicon electrophotographic photosensitive member having reduced image defects, a high electrification capability and a high density, capable of maintaining satisfactory image forming for a long time period, the electrophotographic photosensitive member, and an electrophotographic apparatus.

2. Related Background Art

A material for forming a photoconductive layer in a solid image pickup apparatus, or an electrophotographic photosensitive member for electrophotography or a original reading apparatus in the field of image forming should have characteristics such that it has a high sensitivity and a large SN ratio [photo current (IP)/(Id)] and has absorption spectrum characteristics matching spectrum characteristics of an applied electromagnetic wave, it has a quick optical response and has a desired dark resistance value, it does not harm to human bodies under use conditions, and a remaining image can easily be processed in a predetermined amount of time in the solid image pickup apparatus. The above described harmlessness under use conditions is important especially in the case of electrophotographic photosensitive members for use as office equipment.

Materials that receive attention in view of such aspects include amorphous silicon (hereinafter referred to as "a-Si") with dangling bonds modified with monovalent atoms such as hydrogen and halogen atoms and for example, Japanese Patent Application Laid-Open No. 54-86341 (corresponding to U.S. Pat. No. 4,265,991) describes its application to electrophotographic photosensitive members for electrophotography.

For the method for forming an electrophotographic photosensitive member made of a-Si on a photoconductive substrate, numerous methods have been known such as a sputtering method, a method of thermally decomposing a raw material gas (thermal CVD method), a method of photodecomposing a raw material gas (photo CVD method) and a method of plasma-decomposing a raw material gas (plasma CVD method). Among them, the plasma CVD method, namely a method in which a raw material gas is decomposed by a direct current, a high frequency or a glow discharge to form a deposit film on a conductive substrate is now rapidly proceeding toward commercialization as a method for forming an electrophotographic photosensitive member or the like.

As a layer structure of this deposit film, a structure in which so called a surface layer or upper blocking layer having a blocking power is further stacked on the surface side has been proposed in addition to the electrophotographic photosensitive member in which modified elements are added as appropriate with a-Si as a base material as has been previously practiced.

For example, Japanese Patent Application Laid-Open No. 08-15882 (corresponding to U.S. Pat. No. 6,090,513) discloses a photosensitive member provided with an intermediate layer (upper blocking layer) having a smaller content of carbon atoms than the surface layer and having incorporated therein atoms for controlling a conductivity between a photoconductive layer and a surface layer.

The conventional method for forming an electrophotographic photosensitive member has made it possible to obtain an electrophotographic photosensitive member having practical characteristics and uniformity to some extent. Furthermore, it is possible to obtain an electrophotographic photosensitive member having reduced defects to some extent if the interior of a vacuum reaction vessel is cleaned thoroughly. However, the conventional method for producing an electrophotographic photosensitive member has a problem such that for products that should have a large area and a relatively thick deposit film such as an electrophotographic photosensitive member, it is difficult to meet requirements about optical and electrical characteristics while keeping a high level of uniformity in film quality, and to obtain in a high yield a deposit film having reduced image defects during image forming by an electrophotographic process.

For the a-Si film, in particular, if a dust of several μm is deposited on the surface of the substrate, abnormal growth occurs, i.e. a "spherical protrusion" grows, with the dust as a core during film formation. The spherical protrusion has a shape of inverted cone with the dust as a starting point, and there exist a very large number of localized levels at an interface between a normal deposit portion and a spherical protrusion portion, thus reducing a resistance to cause electric charges to pass through the interface to the substrate side. Consequently, the spherical protrusion portion appears as a white spot in a solid black image on an image (in the case of reversal development, it appears as a black spot in a white image). For the image defect called a "spot", criteria have become severer year by year, and the level of several defects existing on an A3 size paper may be considered unacceptable depending on the size of defects. Furthermore, in the case of the photosensitive member mounted on a color copier, the criteria become still further severe so that the level of only one defect existing on the A3 size paper may be considered unacceptable.

Since the spherical protrusion has a dust as a starting point, a substrate to be used is precisely cleaned before a film is formed thereon, and steps of installing the substrate in a film forming apparatus are all carried out in a clean room or under a reduced pressure. In this way, efforts have been made to reduce an amount of dust deposited on the substrate before film formation to a minimum possible level, and such efforts have brought about some effects. However, occurrence of a spherical protrusion is caused not just by dusts deposited on the substrate. That is, in the case of producing an a-Si photosensitive member, a very large thickness of several μm to several tens of μm, and thus it takes several hours to several tens of hours for forming a film. During the film formation, the a-Si film is deposited on not only the substrate but also the wall of a film forming apparatus and structures in the film forming apparatus. The wall of the oven and the structures do not have controlled surfaces unlike the substrate, and are therefore poor in adhesion properties, causing peeling during film formation over a long time period in some cases. Even a very low level of peeling occurring during film formation results in a dust, which is deposited on the surface of the photosensitive member being deposited, and abnormal growth of a spherical protrusion occur with the dust as a starting point. Thus, for maintaining a high level of yield, not only control of the substrate before film formation but also careful control for prevention of peeling in the film forming apparatus during film formation is required, thus making it difficult to produce an a-Si photosensitive member.

In addition, the accurate mechanism responsible for occurrence of melt-adhesion (deposit partially deposited on the surface of the photosensitive member) and filming (deposit deposited in a form of a thin film on the entire surface of the photosensitive member) causing image defects other then the spot is unknown, but the rough mechanism is estimated as follows. When a frictional force acts between the photosensitive member and the scrubbed portion, then a chatter (vibrations of a cleaning blade caused by a friction between the cleaning blade for cleaning the surface of the photosensitive member and the photosensitive member) occurs in the contact state, and a compression effect is increased in the surface of the photosensitive member so that a toner is strongly pressed against the surface of the photosensitive member, thus causing melt-adhesion and filming. Furthermore, if the process speed of the electrophotographic apparatus rises, the relative speed of the scrubbed portion and the photosensitive member increases, resulting in a situation in which melt-adhesion and filming more easily occurs.

As measures for solving the problems described above, it is known that use of an amorphous carbon layer (hereinafter referred to as a-C:H film) containing hydrogen is effective as described in Japanese Patent Application Laid-Open No. 11-133640 (U.S. Pat. No. 6,001,521) and Japanese Patent Application Laid-Open No. 11-133641. Because the a-C:H film is very hard as it is also called diamond like carbon (DLC), it can be insusceptible to scars and abrasion and has a unique solid wettability, thus being considered as a most suitable material to prevent melt-adhesion and filming.

In fact, it has been shown that melt-adhesion and filming can be effectively prevented in a variety of environments if the a-C:H film is used in the outermost surface of the photosensitive member.

However, there is a problem in terms of production steps in the process for producing an electrophotographic photosensitive member using the a-C:H film as a surface layer. Normally, in formation of a deposit film using a high frequency plasma, a byproduct (polysilane) generated during formation of the deposit film is removed by dry etching or the like to clean the interior of a reaction vessel after completion of formation of the deposit film. However, it takes a larger amount of time to perform etching processing after continuously forming a photosensitive layer to a surface layer (a-C:H) compared to the case where etching processing is performed after continuously forming a photosensitive layer to the conventional surface layer (a-SiC). This is due to the fact that it is very difficult to subject the a-C:H to etching, and represents one of factors responsible for increased production costs.

In addition, there have been cases where a residue of the a-C:H film lightly remains after etching processing, thus causing image defects to occur in the subsequent formation of the deposit film.

On the other hand, in the electrophotographic apparatus, there have been cases where the cleaning blade is damaged due to surface roughness, the spherical protrusion described above and the like depending on the surface condition of the a-Si photosensitive member, and cleaning defects such as slip-through of a developer (toner) occur because a level of slippage between the photosensitive member and the cleaning blade is too high during an early stage of operation, thus causing black lines to appear on the image.

For coping with such problems, the material of the blade, the abutment pressure, the composition of the developer and the like are carefully selected according to the surface state of the photosensitive member in such a manner that for example, the initial blade abutment pressure is set to a high level and then gradually decreased, and so on, whereby the problems can be alleviated to some degree. However, there have been cases where since frequency of maintenance increases and the maintenance becomes complicated for using the electrophotographic apparatus for a long period of time and achieving an improvement of images, new problems arise such that the working efficiency of the electrophotographic apparatus cannot be improved sufficiently, the number of parts is increased and so on.

In addition, there have been cases where when the electrophotographic apparatus is used for a long period of time, the cleaning blade is gradually worn as the photosensitive member rotates, thus making it impossible to clean the toner sufficiently depending on the states of the photosensitive member and the cleaning blade.

In addition, regarding the method for producing the a-Si photosensitive member, the plasma CVD method with a frequency of a VHF band makes it possible to significantly improve the rate of the deposit film compared to the method using a RF band, but regarding surface characteristics, there are cases where the plasma CVD method with a frequency of a VHF band results in a photosensitive member having a rough surface in a microscopic level (submicron order) compared to the surface of the photosensitive member prepared by the method with the RF band depending on production conditions. Therefore, for the photosensitive member prepared by the method with the VHF band, there have been cases where damage of the cleaning blade and cleaning defects such as drop of a toner easily occur, and a latitude for coping with problems is reduced.

In recent years, particularly, progress in digitization of electrophotographic apparatus has raised the level of requirements for image quality to the extent that image defects that could be acceptable in the conventional analog-type apparatus must be perceived as problems.

Thus, effective measures for removing factors of image defects are desired.

SUMMARY OF THE INVENTION

The object of the present invention is to provide a method for producing an electrophotographic photosensitive member having reduced image defects, and capable of maintaining high image quality for a long time period and being easily used, in which the problems in conventional photosensitive members are solved without sacrificing electrical characteristics and electrophotographic photosensitive members can be unexpensively and stably produced in high yields, the electrophotographic photosensitive member and an electrophotographic apparatus.

Specifically, the present invention provides a method for an electrophotographic photosensitive member including layers each constituted by a non-single crystal material, comprising the steps of placing a substrate having a conductive surface in a film forming apparatus capable of being airtight-sealed under a reduced pressure comprising evacuating means and raw material gas supplying means, and decomposing at least a raw material gas by a high frequency power to form a first layer constituted by at least a non-single crystal material on the substrate as a first step; exposing the substrate with the first layer formed thereon to a gas containing oxygen and water vapor as a second step; and decomposing at least a raw material gas by a high frequency power in said film forming apparatus to form on the first layer a second layer including an upper blocking layer constituted by a non-single crystal material as a third step, the electrophotographic photosensitive member, and an electrophotographic apparatus.

In the present invention, air may be used as the above described gas containing oxygen and hydrogen.

Furthermore, in the second step, the substrate with the above described first layer deposited thereon may be taken out from the above described film forming apparatus and exposed to air, and a step of subjecting the surface of the photosensitive member with the above described first layer stacked thereon to processing such as polishing is more preferably included. Furthermore, during the step, the photosensitive member may be inspected. Specifically, a visual check, image inspection, potential inspection and the like are carried out. After inspection, the photosensitive member is washed with water, whereby adhesion properties when the upper blocking layer is subsequently deposited thereon are improved, and peeling is effectively prevented.

Furthermore, a surface layer may be deposited on the upper blocking layer, and the temperature of the substrate may be changed at this time.

The above described surface layer constituted by a non-single crystal material having carbon atoms as a base material herein mainly refers to amorphous carbon having a nature midway between black lead (graphite) and diamond, but may partially include a microcrystal and a multicrystal.

DETAILED DESCRIPTION OF THE PREFERRED EMBODIMENTS

Figure 1:
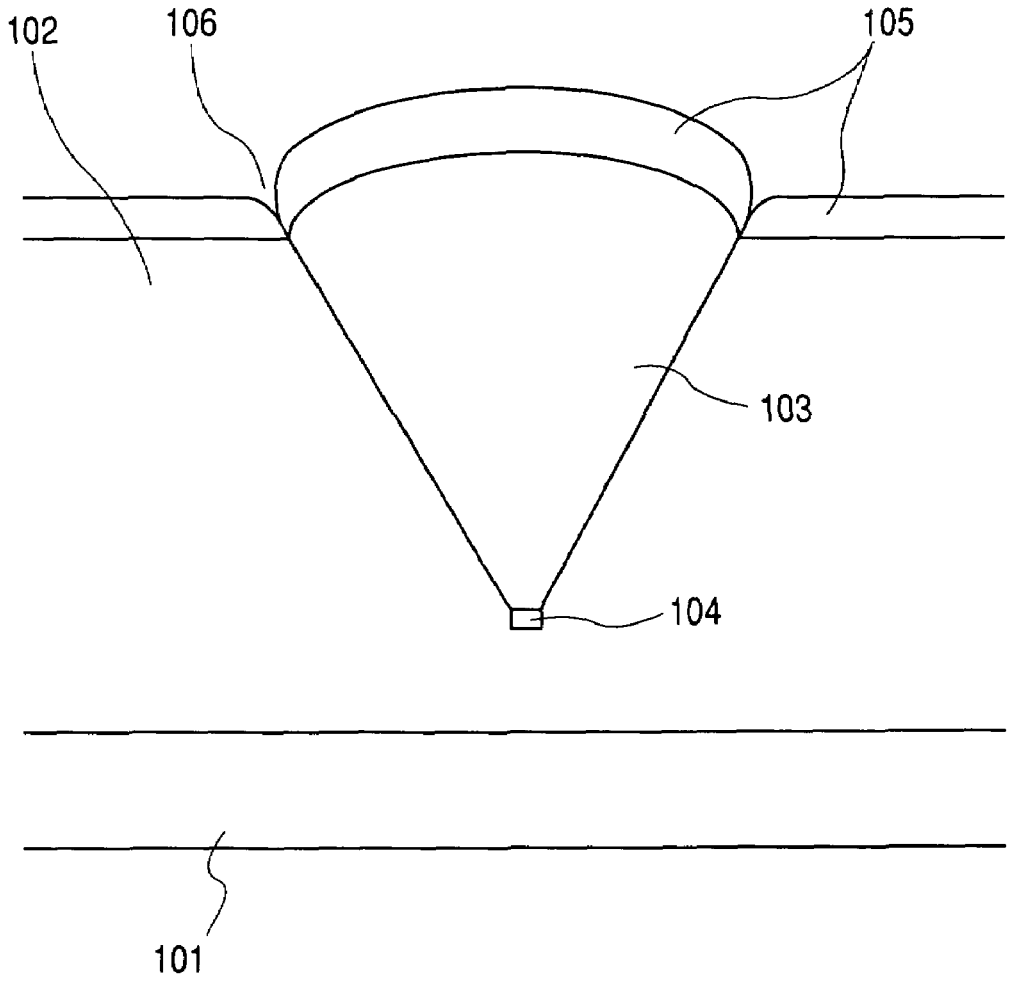
FIG. 1 is a schematic sectional view showing one example of a spherical protrusion of an electrophotographic photosensitive member.

The conventional method for forming an electrophotographic photosensitive member has made it possible to obtain an electrophotographic photosensitive member having practical characteristics and uniformity to some extent. Furthermore, it is possible to obtain an electrophotographic photosensitive member having reduced defects to some extent if the interior of a vacuum reaction vessel is cleaned thoroughly. However, the conventional method for producing an electrophotographic photosensitive member has a problem such that for products that should have a large area and a relatively thick deposit film such as an electrophotographic photosensitive member for electrophotography for example, it is difficult to meet requirements about optical and electrical characteristics while keeping a high level of uniformity in film quality, and to obtain in a high yield a deposit film having reduced image defects during image forming by an electrophotographic process.

For the a-Si film, in particular, if a dust of several μm is deposited on the surface of the substrate, abnormal growth occurs, i.e. a "spherical protrusion" grows, with the dust as a core during film formation. The spherical protrusion has a shape of inverted cone with the dust as a starting point, and there exist a very large number of localized levels at an interface between a normal deposit portion and a spherical protrusion portion, thus reducing a resistance to cause electric charges to pass through the interface to the substrate side. Consequently, the spherical protrusion portion appears as a white spot in a solid black image on an image (in the case of reversal development, it appears as a black spot in a white image). For the image defect called a "spot", criteria have become severer year by year, and the level of several defects existing on an A3 size paper may be considered unacceptable depending on the size of defects. Furthermore, in the case of the photosensitive member mounted on a color copier, the criteria become still further severe so that the level of only one defect existing on the A3 size paper may be considered unacceptable.

Since the spherical protrusion has a dust as a starting point, a substrate to be used is precisely cleaned before a film is formed thereon, and steps of installing the substrate in a film forming apparatus are all carried out in a clean room or under a reduced pressure. In this way, efforts have been made to reduce an amount of dust deposited on the substrate before film formation to a minimum possible level, and such efforts have brought about some effects. However, occurrence of spherical protrusions is caused not just by dusts deposited on the substrate. That is, in the case of producing an a-Si photosensitive member, a very large thickness of several μm to several tens of μm is required, and thus it takes several hours to several tens of hours to for forming a film. During the film formation, the a-Si film is deposited on not only the substrate but also the wall of a film forming apparatus and structures in the film forming apparatus. The wall of the oven and the structures do not have controlled surfaces unlike the substrate, and are therefore poor in adhesion properties, causing peeling during film formation over a long time period in some cases. Even a very low level of peeling occurring during film formation results in a dust, which is deposited on the surface of the photosensitive member being deposited, and abnormal growth of spherical protrusions occur with the dust as a starting point. Thus, for maintaining a high level of yield, not only control of the substrate before film formation but also careful control for prevention of peeling in the film forming apparatus during film formation is required, thus making it difficult to produce an a-Si photosensitive member.

The inventors have conducted studies to alleviate image defects caused by the spherical protrusion, which poses a serious problem in a photosensitive member constituted by a non-single crystal material, particularly an a-Si photosensitive member. In particular, the inventors have strenuous efforts to prevent image defects caused by the spherical protrusion resulting from peeling from the wall of the film forming apparatus and structures in the oven during film formation.

As described previously, the spherical protrusion develops into image defects like a spot because there exist a very large number of localized levels at an interface between a normal deposit portion and a spherical protrusion portion of the deposit film, thus reducing a resistance to cause electric charges to pass through the interface to the substrate side. However, the spherical protrusion resulting from a dust deposited during film formation grows not from the substrate but from some midpoint in the deposit film, and therefore if some blocking layer is provided on the surface side to prevent entrance of electric charges, the spherical protrusion could be prevented from developing into image defects.

Thus, the inventors conducted an experiment such that film forming conditions allowing a spherical protrusion to grow from some midpoint in the deposit film were selected, and an upper blocking layer was provided on the surface of a photosensitive member prepared under the conditions. Unexpectedly, however, entrance of electric charges from the spherical protrusion could not be prevented, thus causing image defects.

For tracking down the cause, the spherical protrusion was cut to expose a section, and the section was observed by a SEM (scanning electron microscope). The result of observation is shown in FIG. 1. In FIG. 1, reference numeral 101 denotes a conductive substrate, reference numeral 102 denotes a normal deposit portion of a first layer, reference numeral 103 denotes a spherical protrusion, a reference numeral 104 denotes a dust deposited during film formation, reference numeral 105 denotes an upper blocking layer, and reference numeral 106 denotes an interface between a spherical protrusion portion and the normal deposit portion. As apparent from FIG. 1, the spherical protrusion 103 grows from some midpoint in the normal deposit portion of the first layer 102 with the dust 104 as a starting point, and the interface 106 exists between the spherical protrusion 103 and the normal deposit portion. Electric charges pass through the interface to the substrate side, thus causing a spot on the image. Even through the upper blocking layer 105 is deposited on the spherical protrusion 103, the upper blocking layer 105 is deposited while a growth pattern of the hitherto growing spherical protrusion 103 is maintained, and therefore the interface 106 also creates in the upper blocking layer 105. As a result, electric charges pass through the interface, and thus the function as the upper blocking layer cannot be performed.

As a result of conducting studies for preventing growth of the interface 106 at the time when the upper blocking layer 105 is stacked, the inventors have found that the growth of the interface can be inhibited if the photosensitive member is exposed to a gas containing oxygen and water vapor, for example air, and thereafter the upper blocking layer is formed.

Figure 2:
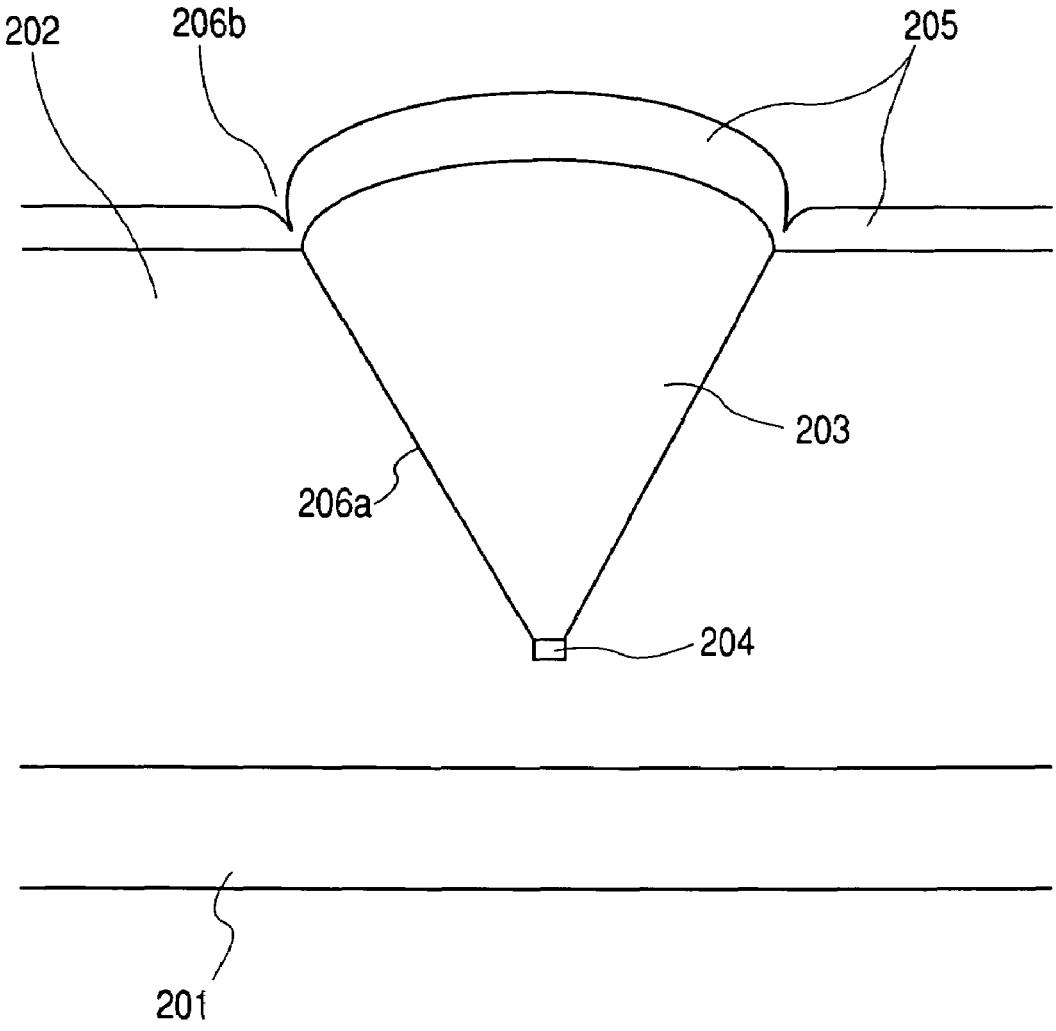
FIG. 2 is a schematic sectional view showing one example of the spherical protrusion of the electrophotographic photosensitive member of the present invention.

For examining this situation, the spherical protrusion was cut to expose a section, and the section was observed by a SEM (scanning electron microscope). The result of observation is shown in FIG. 2. A spherical protrusion 203 starts growing with a dust 204 deposited during formation of a normal deposit portion of a first layer 202 deposited on a substrate 201 as a starting point. However, the photosensitive member temporarily exposed to air is different in that when an upper blocking layer 205 is stacked, an interface portion 206*b* observed in the surface of the upper blocking layer is broken off from an interface 206*a* between the normal deposit portion and the spherical protrusion 203 of the first layer 202. That is, it is estimated that since the first layer 202 is temporarily taken out from the film forming apparatus and exposed to air after it is formed, some change occur in the surface of the first layer, and when thereafter it is returned to the film forming apparatus to form the upper blocking layer 205, the growth surface thereof becomes discontinuous. As a result, the interface portion 206*a* between the spherical protrusion portion 203 of low resistance and the normal deposit portion is sealed by the upper blocking layer 205, thus making it difficult to electric charges to pass through the interface 206*a*, whereby image defects can be inhibited.

Although details about the change occurring in the surface of the first layer 202 is still unknown, the effect as described above could not be obtained when the first layer was kept in the film forming apparatus while introducing therein oxygen instead of air. From this fact, it is estimated that the effect is not associated with a simple cause such as oxidation of the surface due to exposure to air but with a more complicated phenomenon involving humidity in atmosphere, other components and the like.

Furthermore, it has been shown that for preventing electric charges from passing though the spherical protrusion 203, it is effective to polish the head of the spherical protrusion 203 to be flattened after forming the first layer 202.

Figure 3:
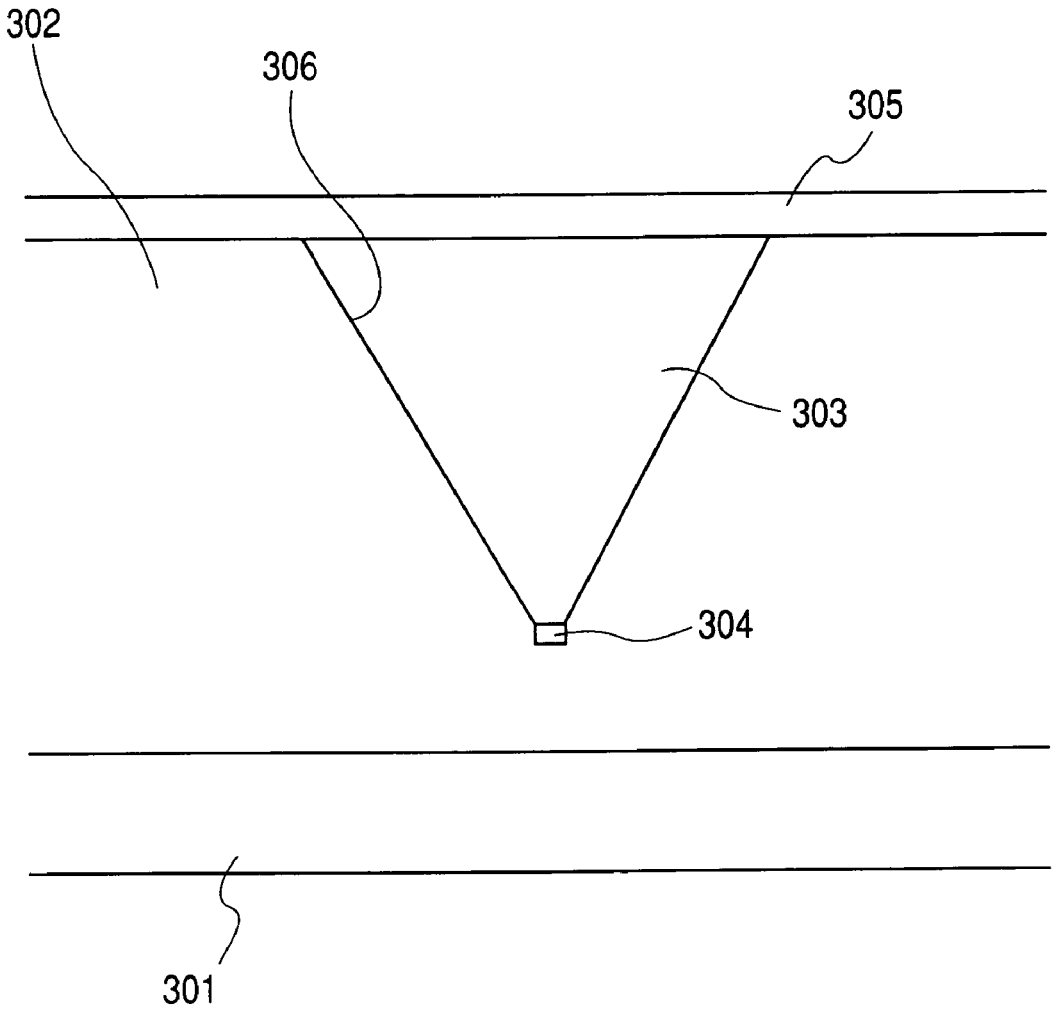
FIG. 3 is a schematic sectional view showing one example of the spherical protrusion of the electrophotographic photosensitive member of the present invention with the surface polished in the second step.

FIG. 3 shows one example of an electrophotographic photosensitive member in which the head of a spherical protrusion 303 is polished and thereby be flattened after a first layer 302 is formed on a substrate 301. The spherical protrusion 303 starts growing with a dust 304 deposited during formation of a normal deposit portion of the first layer 302 as a starting point. However, the head of the spherical protrusion 303 is polished by polishing means and thereby flattened before an upper blocking layer 305 is deposited. Consequently, the upper blocking layer 305 to be subsequently formed takes over no interface portion 306, and is uniformly deposited on the flattened surface. Consequently, when the upper blocking layer 305 is stacked after the first layer 202 is flattened by polishing means, the interface 306 between the spherical protrusion portion 303 and the normal deposit portion of the first layer 302 is more sufficiently sealed, thus making it still more difficult for electric charges to pass through the interface 306, and thereby the effect of inhibiting image defects is still further improved.

The present invention is equally effective irrespective of whether the photosensitive member is a positive-charge photosensitive member or negative-charge photosensitive member, but the negative-charge photosensitive member has a higher level of passage of electric charges due to the spherical protrusion, and is therefore significantly affected even by a relatively small spherical protrusion. Thus, the present invention is especially effective in the negative-charge photosensitive member.

Furthermore, it has been shown that by processing the surface of the deposit film of the first layer into a surface state in which the arithmetic average roughness (Ra) measured in the coverage of 10 μm×10 μm is 25 nm or less, the adhesiveness of a film with a second layer deposited thereon is also sufficiently improved.

Furthermore, regarding cleaning defects in the electrophotographic apparatus, the inventors have conducted vigorous studies on a mechanism responsible for slip-through of toner.

Conventionally, only abnormal growth defects are polished and flattened using a polishing apparatus for the surface of the a-Si photosensitive member. As a result, fine irregularities remain on the surface of the a-Si photosensitive member without being flattened. If a photosensitive member having such a surface state is installed in the electrophotographic apparatus, the cleaning blade excessively slips due to the fine irregularities during the initial stage of operation, and therefore the developer is slipped through to cause cleaning defects. It is therefore considered that cleaning defects occur due to the situation in which the surface of the photosensitive member has a high level of roughness, and thus the level of slippage between the blade and the photosensitive member is so high that a developer such as a toner is slipped through.

Based on this consideration, the surface of the first layer was processed into a surface state in which the arithmetic average roughness (Ra) measured in the coverage of 10 μm×10 μm is 25 nm or less, thereby making it possible to prevent occurrence of cleaning defects.

Furthermore, by processing the surface of the first layer into the surface state described above, influences of reflection due to the surface state can be prevented even in the case of a system using coherent light, thus making it possible to inhibit occurrence of interference patterns.

Figure 4:
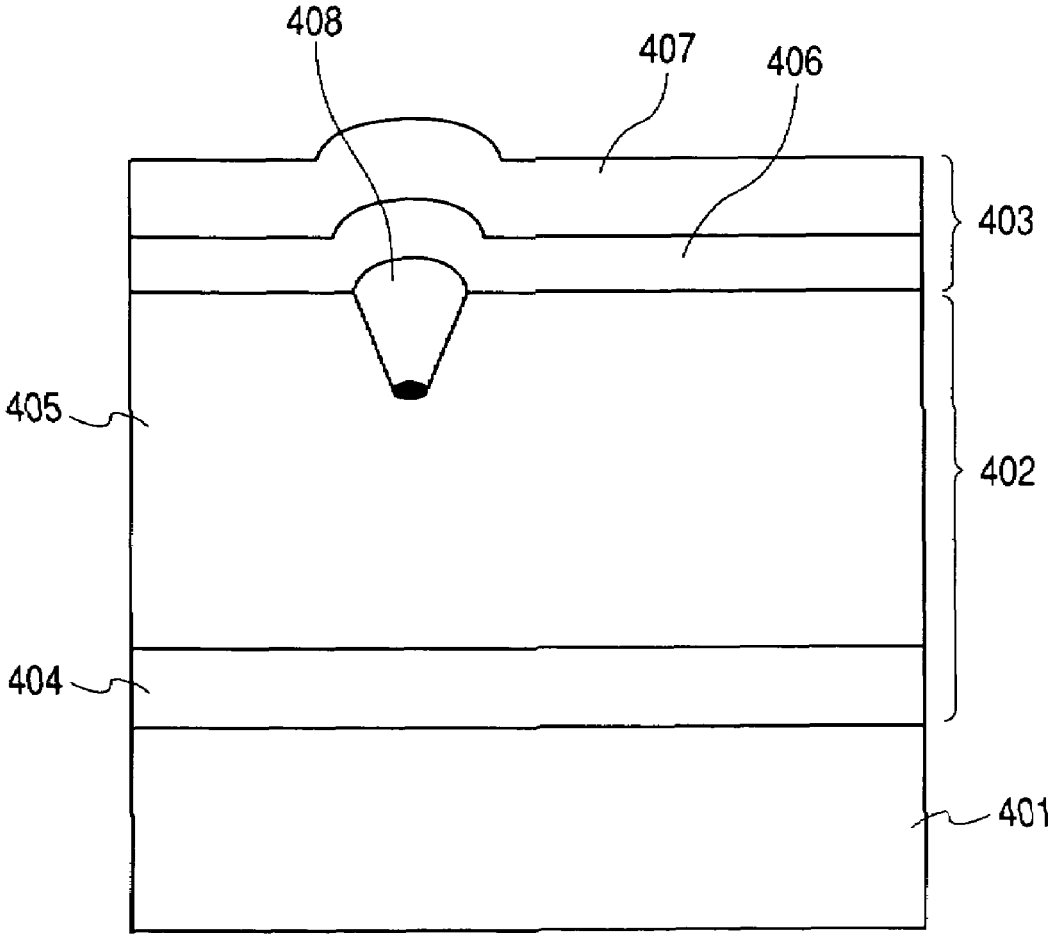
FIG. 4 is a schematic sectional view showing one example of the electrophotographic photosensitive member of the present invention.

The present invention will be described in detail below, referring to the drawings as required. a-Si photosensitive member according to the invention One example of an electrophotographic photosensitive member according to the present invention is shown in FIG. 4.

The electrophotographic photosensitive member of the present invention is such that a first layer 402 is stacked on a substrate 401 constituted by a conductive material such as Al and stainless, for example, as a first step, the substrate with the first layer stacked thereon is temporarily exposed to a gas containing oxygen and water vapor (e.g. air) as a second step, and a second layer 403 including an upper blocking layer 406 is stacked as a third step. By producing the electrophotographic photosensitive member in this way, the upper blocking layer 406 can be deposited in such a manner as to cover a spherical protrusion 408 generated in the first layer, and therefore the spherical protrusion 408 never appears in the image even if it exists, thus making it possible to maintain satisfactory image quality. In the present invention, the first layer 402 includes a photoconductive layer 405. a-Si is used for the material of the photoconductive layer 405. In addition, a material having a-Si as a base material and containing carbon, nitrogen or oxygen as required is used for the upper blocking layer 406. Desirably, an element of Group 13 or Group 15 of the periodic table or the like is selected and incorporated as a dopant in the upper blocking layer 406 in terms of improvement in charging performance and for making it possible to perform control of charge polarity such as a positive charge and a negative charge.

Furthermore, a lower blocking layer 404 may be provided on the first layer 402 as required. A material having a-Si as a base material and containing carbon, nitrogen or oxygen as required is used for the lower blocking layer 404. Furthermore, by selecting and incorporating as a dopant an element of Group 13 or Group 15 of the periodic table or the like is selected as a dopant and incorporated in the lower blocking layer 404, thereby making it possible to perform control of charge polarity such as a positive charge and a negative charge.

Specifically, elements of Group 13 of the periodic table as dopants include boron (B), aluminum (Al), gallium (Ga), indium (In) and thallium (Tl), and B and Al are especially suitable. Elements of Group 15 of the periodic table include phosphorous (P), arsenic (As), antimony (Sb) and bismuth (Bi), and P is especially suitable.

In addition, a surface layer 407 may be provided on the upper blocking layer 406 in the second layer 403 as required. For the surface layer 407, a layer having a-Si as a base material and containing in a relatively large amount at least one of carbon, nitrogen and oxygen is used, whereby environmental resistance, abrasion resistance and scare resistance can be improved. Furthermore, by using a surface layer constituted by a non-single crystal material having carbon atom as a base material, abrasion resistance and scare resistance can still further be improved.

Furthermore, at least a first area of the photoconductive layer 405 may be deposited as the first layer 402, and then at least a second area of the photoconductive layer and upper blocking layer 406 may be deposited as the second layer.

Shape and material of substrate according to the invention

The shape of the substrate 401 may be a desired shape compatible with a working system of the electrophotographic photosensitive member and the like. For example, it may be a cylinder or tabular edgeless belt having a flat surface or irregular surface, and its thickness is determined as appropriate so that a desired electrophotographic photosensitive member can be formed, but if a certain level of flexibility as an electrophotographic photosensitive member is required, the thickness may be reduced to a minimum as long as a function as a cylinder or belt can be sufficiently performed. Nevertheless, it is preferable that the cylinder usually has a thickness of 10 μm or greater in terms of production, handling, mechanical strength and the like.

For the material of the substrate, a conductive material such as Al and stainless is generally used, but a nonconductive material such as various kinds of plastics, glasses and ceramics rendered conductive by depositing such a conductive material on at least the surface thereof on which a photoreceptive layer may also be used.

Conductive materials include, in addition to those described above, metals such as Cr, Mo, Au, In, Nb, Te, V, Ti, Pt, Pd and Fe, and alloys thereof.

Plastics include films and sheets of polyester, polyethylene, polycarbonate, cellulose acetate, polypropylene, polyvinyl chloride, polystyrene, polyamide and the like.

First layer According to the Invention

In the present invention, the first layer 402 is constituted by an amorphous material having silicon atoms as a base material and containing hydrogen and/or halogen atoms (abbreviated as "a-Si (H, X)".

The a-Si film can be formed by the plasma CVD method, the sputtering method, the ion plating method or the like, but the plasma CVD method is particularly preferable because a film formed using the plasma CVD method is excellent in quality. As a raw material gas, a silicon hydride (silane) such as $SiH_4$, $Si_2H_6$, $Si_3H_8$ or $Si_4H_{10}$ in a gaseous state or capable of being formed into a gas is decomposed with high frequency power, whereby the film can be formed. Furthermore, $SiH_4$ and $Si_2H_6$ are preferable in terms of easy handling in formation of the layer and high Si supply efficiency.

At this time, the substrate is preferably kept at a temperature of 200° C. to 450° C., more preferably 250° C. to 350° C. from a viewpoint of properties. This is because if the substrate is kept at such a temperature, the surface reaction on the surface of the substrate is promoted to achieve sufficient structural relaxation. Furthermore, it is also preferable that the above described gas is further mixed with a desired amount of gas containing $H_2$ or halogen atoms to form a layer in terms of improvement in properties. Gases effective as halogen atom supplying raw material gases may include interhalogens such as fluorine gases ($F_2$), BrF, ClF, $ClF_3$, $BrF_3$, $BrF_5$, $IF_5$ and $IF_7$. Silicon compounds containing halogen atoms, i.e. silane derivatives substituted with halogen atoms may include specifically silicon fluorides such as $SiF_4$ and $Si_2F_6$ as preferable compounds. Furthermore, those carbon supplying raw material gases may be diluted with gases such as $H_2$, He, Ar and Ne as required.

The thickness of the first layer 402 is not specifically limited, but is the appropriate thickness is about 15 to 50 μm in consideration of production costs and the like.

Furthermore, for improving properties, the first layer 402 may have a multilayer structure. For example, a layer having a smaller band gap is placed on the surface side and a layer having a larger band gap is placed on the substrate side, whereby photosensitivity and charge performance can be improved at the same time. Particularly, for a light source having a relatively large wavelength and having almost no variation in wavelength such as a semiconductor laser, a breakthrough effect is exhibited by modifying a layer structure in this way.

The lower blocking layer 404 provided as required is generally based on a-Si (H, X), and by incorporating therein a dopant such as an element of Group 13 or Group 15 of the periodic table, it makes possible to provide the lower blocking layer 404 with a capability of controlling a conduction type to block a carrier entering from the substrate. In this case, by incorporating at least one element selected from C, N and O in the lower blocking layer, the stress of the lower blocking layer can be adjusted to improve the adhesion properties of the photosensitive layer.

For the element of Group 13 or Group 15 of the periodic table for use as a dopant of the lower blocking layer 404, the elements described previously are used. Furthermore, raw materials for introducing an atom of Group 13 include specifically boron hydrides such as $B_2H_6$, $B_4H_{10}$, $B_5H_9$, $B_5H_{11}$, $B_6H_{10}$, $B_6H_{12}$, and $B_6H_{14}$ and boron halides such as $BF_3$, $BCl_3$ and $BBr_3$ for introduction of a boron atom. In addition thereto, $AlCl_3$, $GaCl_3$, $Ga(CH_3)_3$, $InCl_3$, $TlCl_3$ and the like may be used. Among them, $B_2H_6$ is one of preferable raw materials in terms of handling.

Materials that are effectively used as raw material for introducing an atom of Group 15 include phosphorous hydrides such as $PH_3$ and $P_2H_4$, phosphorous halides such as $PF_3$, $PF_5$, $PCl_3$, $PCl_5$, $PBr_3$ and $PI_3$, and $PH_4I$ for introduction of a phosphorous atom. In addition thereto, $AsH_3$, $AsF_3$, $AsCl_3$, $AsBr_3$, $AsF_5$, $SbH_3$, $SbF_3$, $SbF_5$, $SbCl_3$, $SbCl_5$, $BiH_3$, $BiCl_3$, $BiBr_3$ and the like are used as effective starting materials for introducing an element of Group 15.

The content of dopant atom is preferably $1\times10^{-2}$ to $1\times10^{4}$ atomic ppm, more preferably $5\times10^{-2}$ to $5\times10^{3}$ atomic ppm, most preferably $1\times10^{-1}$ to $1\times10^{3}$ atomic ppm.

A non-single crystal silicon carbide layer stacked on a photoconductive layer is included in the first layer.

In the above described first step, the silicon carbide layer is stacked on the outermost surface of the first layer, whereby the adhesion between the second layer stacked in the third step and the first layer, thus making it possible to considerably widen a latitude for peeling.

Furthermore, in the second step, an effect of inhibiting occurrence of polishing scares when the surface of the first layer is subjected to polishing processing can be obtained.

Second Layer According to the Invention

The second layer 403 according to the present invention is formed after an electric discharge is temporarily stopped to make the photosensitive member contact a gas containing oxygen and water vapor after the first layer 402 is formed. For the gas containing oxygen and water vapor, atmospheric air that is air under a normal environment may be used. That is, the contacting gas contains at least oxygen and water vapor, and contains an inert gas such as nitrogen as required. For example, the content of oxygen in the total gas is preferably 5% by volume or greater. Alternatively, pure oxygen with water vapor added thereto may be used, but a content of oxygen equivalent to that in air is usually sufficient. Furthermore, the water vapor should only be added so that the relative humidity at a room temperature of 25° C. is, for example, 1% or greater, preferably about 10% or greater. Under usual conditions, atmospheric air that is air under environment is preferably used in terms of process simplification.

In the case where atmospheric air is used, usually a pressure of 1 atmosphere is conveniently used, but a pressure of 1 atmosphere is not necessarily used for achieving the effect of the present invention. Specifically, a pressure equal to or greater than 0.01 atmospheres (1010 Pa) allows the effect of the present invention to be achieved sufficiently. Furthermore, in the case where a gas containing oxygen and water vapor is used, similarly a pressure equal to or greater than 0.01 atmospheres allows the effect of the present invention to be achieved sufficiently.

For the method for making the photosensitive member contact atmospheric air, the photosensitive member may be taken out from the film forming apparatus to make it contact the air after the first layer 402 is formed, or atmospheric air (or gas containing oxygen and water vapor) may be introduced into the film forming apparatus. Furthermore, at this time, the head of a spherical protrusion existing on the surface is preferably polished by polishing means and thereby flattened. Such processing can be performed by a surface polishing apparatus described later. By flattening the spherical protrusion, passage of electric charges can be prevented more effectively, damage of the cleaning blade and cleaning defects due to the spherical protrusion can be avoided, and occurrence of melt-adhesion with the spherical protrusion as a starting point can be prevented.

Furthermore, it is also useful to visually inspect the photosensitive member and evaluate the properties of the photosensitive member as required when the photosensitive member (substrate with first layer formed thereon) is taken out from the film forming apparatus. By making inspections at this time, subsequent steps can be omitted for photosensitive members of defective quality, thus making it possible to reduce costs as a whole.

Furthermore, it is desirable to wash the photosensitive member (substrate with first layer formed thereon) before it is placed again in the film forming apparatus for improving the adhesion properties of the second layer 403 and reducing dust deposition. For the specific method for washing the photosensitive member, the surface is wiped by a piece of clean cloth or paper, or it is desirably subjected to precise washing such as organic medium washing and water washing. Particularly, water washing by a water washing apparatus described later is more preferable from a viewpoint of considerations against environments in recent years.

The upper blocking layer 406 is included in the second layer 403 of the present invention. The upper blocking layer 406 has a function to block electric charges introduced from the surface side to the first layer side when the photosensitive member has its free surface subjected to charging processing with a certain polarity, and no such function is performed when the photosensitive member is subjected to charging processing with an opposite polarity. For imparting such a function to the upper blocking layer 406, an impurity atom for controlling a conductivity should be appropriately incorporated in the upper blocking layer 406. For the impurity atom for use for this purpose, atoms of Group 13 or Group 15 of the periodic table may be used in the present invention. Such atoms of Group 13 include specifically boron (B), aluminum (Al), gallium (GA), indium (In) and thallium (Tl), and boron is especially suitable. The atoms of Group 15 include specifically phosphorous (P), arsenic (As), antimony (Sb) and bismuth (Bi), and phosphorous is especially suitable.

The required content of impurity atoms for controlling a conductivity that are contained in the upper blocking layer 406 is preferably determined as appropriate in consideration of the composition of the upper blocking layer 406 and the production method, but is generally preferably 100 to 30,000 atomic ppm with respect to network constituent atoms.

The atoms for controlling a conductivity that are contained in the upper blocking layer 406 may be evenly distributed in the upper blocking layer 406, or may be distributed unevenly in the direction of thickness. In any case, however, in the in-plane direction parallel to the surface of the substrate, the atoms should be evenly distributed in achieving uniformity of properties in the in-plane direction.

The upper blocking layer 406 may be made of any a-Si based material, but is preferably constituted by a material similar to that of the surface layer 407 described later. Specifically, materials such as "a-SIC:H, X", "a-SiO:H, X", "a-SiN:H, X" and "a-SiCON:H, X" are suitably used. Carbon atoms, nitrogen atoms or oxygen atoms contained in the upper blocking layer 406 may be evenly distributed in the layer, or may be unevenly distributed in the direction of thickness. In any case, however, in the in-plane direction parallel to the surface of the substrate, the atoms should be evenly distributed in achieving uniformity of properties in the in-plane direction.

The content of carbon atoms and/or nitrogen atoms and/or oxygen atoms contained in the entirely area of the upper blocking layer 406 in the present invention is determined as appropriate so that the object of the present invention is effectively achieved, but is preferably in the range of 10% to 70% with respect to the total amount of the atoms and silicon as an amount of atom when one of the three types of atoms is contained, or as a total amount of atoms when two or more types of atoms are contained.

Furthermore, in the present invention, it is necessary that hydrogen atoms and/or halogen atoms should be contained in the upper blocking layer 406, this is absolutely essential for compensating for uncombined bonds of silicon atoms to improve layer quality, especially photoconductive characteristics and electric charge retention characteristics. The content of hydrogen is usually 30 to 70 atomic %, preferably 35 to 65 atomic %, most preferably 40 to 60 atomic % with respect to the total amount of constituent atoms. Furthermore, the content of halogen atom is usually 0.01 to 15 atomic %, preferably 0.1 to 10 atomic %, most preferably 0.5 to 5 atomic %.

The thickness of the upper blocking layer 406 is adjusted so that image defects caused by spherical protrusions 408 can be effectively prevented. The spherical protrusions 408 are different in size when viewed from the surface side, but those of larger diameters allow a larger amount of electric charges to be introduced, and thus more likely appear in the image. Therefore, the increasing of the thickness of the upper blocking layer 406 is more effective against larger spherical protrusions. Specifically, the thickness is desirably $10^{-4}$ times or more as large as the diameter of the largest one of spherical protrusions 408 existing on the electrophotographic photosensitive member after the second layer is deposited. By setting the thickness to within this range, passage of electric charges from spherical protrusions 408 can be prevented effectively. Furthermore, the upper limit of the thickness is desirably 1 μm or less in that a reduction in sensitivity is kept to a minimum.

It is also preferable that the upper blocking layer 406 has is composition continuously changed along the direction from the first layer 402 to the surface layer 407 for improvement of adhesion properties, prevention of interference and the like.

For forming the upper blocking layer 406 having properties capable of achieving the object of the present invention, the mixing ratio of a Si supplying gas to a gas for supplying C and/or N and/or O, the gas pressure in the reaction vessel, the electric discharge power and the temperature of the substrate are appropriately selected.

Materials capable of being used as silicon (Si) supplying gases for use in formation of the upper blocking layer include silicon hydrides (silanes) that are each in a gaseous state or capable of being formed into a gas such as $SiH_4$, $Si_2H_6$, $Si_3H_8$ and $Si_4H_{10}$ as materials that are effectively used, and $SiH_4$ and $Si_2H_6$ are preferable in terms of easy handling in formation of the layer and high Si supply efficiency. Furthermore, the Si supplying raw material gases may be diluted with gases such $H_2$, He, Ar and Ne as required.

Materials capable of being used as carbon supplying gases include hydrocarbons that are each in a gaseous state or capable of being formed into a gas such as $CH_4$, $C_2H_2$, $C_2H_6$, $C_3H_8$ and $C_4H_{10}$ as materials that are effectively used, and $CH_4$, $C_2H_2$ and $C_2H_6$ are preferable in terms of easy handling in formation of the layer and high C supply efficiency. Furthermore, the C supplying raw material gases may be diluted with gases such $H_2$, He, Ar and Ne as required.

Materials capable of being used as nitrogen or oxygen supplying gases include compounds that are each in a gaseous state or capable of being formed into a gas such as $NH_3$, NO, $N_2O$, $NO_2$, $O_2$, CO, $CO_2$ and $N_2$. Furthermore, nitrogen or oxygen supplying raw material gases may be diluted with gases such $H_2$, He, Ar and Ne as required.

The optimum range of the pressure in the reaction vessel is similarly selected as appropriate according to a layer design, but the pressure is usually $1\times10^{-2}$ to $1\times10^{3}$ Pa, preferably $5\times10^{-2}$ to $5\times10^{2}$ Pa, most preferably $1\times10^{-1}$ to $1\times10^{2}$ Pa.

Furthermore, the optimum range of the temperature of the substrate is selected as appropriate according to a layer design, but usually the temperature is preferably 150 to 350° C., more preferably 180 to 330° C., most preferably 200 to 300° C. The set temperature of the substrate when the first layer is formed in the first step may be identical to or different from the set temperature of the substrate when the second layer is formed in the third step, and the temperature most suitable for each layer is desirably selected.

In the present invention, layer fabrication factors such as the mixing ratio of the diluting gas, the gas pressure, the discharging power and the temperature of the substrate for forming the upper blocking layer 406 are not usually determined independently, but the optimum vale of each layer fabrication factor is desirably determined based on mutual and organic correlation for forming a photosensitive member having desired characteristics.

Furthermore, in the second layer of the present invention, an a-Si based intermediate layer may be provided below the upper blocking layer as required.

The intermediate layer is constituted by a non-single crystal material containing hydrogen and/or a halogen, having as a base an amorphous silicon (a-Si (H, X)) with silicon atoms as a base material, and further containing at least one type of atom selecting from carbon, nitrogen and oxygen atoms. Such non-single crystal materials include amorphous silicon carbide, amorphous silicon nitride and amorphous silicon oxide.

In this case, the composition of the intermediate layer may be continuously changed along the direction from the photoconductive layer to the upper blocking layer for improving the film adhesion properties.

For forming the intermediate layer, the temperature of the substrate (Ts) and the gas pressure in the reaction vessel should be appropriately selected as desired. The optimum range of the temperature of the substrate (Ts) is determined as appropriate according to a layer design, but usually the temperature is preferably 150 to 350° C., more preferably 180 to 330° C., most preferably 200 to 300° C.

The optimum range of the pressure in the reaction vessel is similarly selected as appropriate according to a layer design, but the pressure is usually $1\times10^{-2}$ to $1\times10^{3}$ Pa, preferably $5\times10^{-2}$ to $5\times10^{2}$ Pa, most preferably $1\times10^{-1}$ to $1\times10^{2}$ Pa.

In the present invention, the surface layer 407 constituted by a non-single crystal material, particularly a-Si based material may be further provided on the upper blocking layer 406 in the second layer 403 as required. The surface layer 407 has a free surface and mainly contributes to improvements in humidity resistance, continuous repeated usability, electric pressure resistance, service condition characteristics and durability.

The a-Si based surface layer 407 has sufficient chemical stability at the interface between stacked layers because the photoconductive layer 405 and the upper blocking layer 406 constituting the first layer and the amorphous material constituting the surface layer 407 both have a common component, i.e. silicon atoms. If an a-Si based material is used as a material of the surface layer 407, a compound containing at least one type of atom selected from carbon, nitrogen and oxygen combined with silicon atoms is preferably used, and a compound having a-SiC as a main component is especially preferably used.

If the surface layer 407 contains at least one of carbon, nitrogen and oxygen, the content of such atoms is preferably in the range of 30% to 90% with respect to all atoms constituting the network.

Furthermore, hydrogen atoms and/or halogen atoms should be contained in the surface layer 407, which is intended for compensating for uncombined bonds of silicon atoms, and improving layer quality, particularly electric charge retention characteristics. Desirably, the content of hydrogen is usually 30 to 70 atomic %, preferably 35 to 65 atomic %, most preferably 40 to 60 atomic % with respect to the total amount of the constituting atoms. Furthermore, desirably the content of fluorine atom is usually 0.01 to 15 atomic %, preferably 0.1 to 10 atomic %, most preferably 0.5 to 5 atomic %.

The photosensitive member formed with these ranges of contents of hydrogen and/or fluorine can be sufficiently applied as an excellent photosensitive member. That is, defects (mainly dangling bonds of silicon atoms and carbon atoms) existing in the surface layer 407 are known to have detrimental effects on characteristics as those of an electrophotographic photosensitive member. These detrimental effects include a reduction in charge performance due to, for example, introduction of electric charges from the free surface, a change in charge performance due to a change in service conditions, for example a change in surface structure under a high humidity, and occurrence of an image persistence phenomenon through repeated use due to a situation in which electric charges are introduced into the surface layer from the photoconductive layer during corona discharge or exposure to light to have the electric charges trapped in the defects in the surface layer.

However, by performing control so that the content of hydrogen in the surface layer 407 is 30 atomic % or greater, defects in the surface layer are significantly reduced and as a result, improvements can be achieved in electric characteristics and continuous usability at a high speed compared to the conventional technique.

On the other hand, if the content of hydrogen in the surface layer 407 is greater than 70 atomic %, the hardness of the surface layer drops, and therefore repeated use can no longer endured. Therefore, it is one of important factors in achieving excellent desired electrophotographic characteristics to perform control to keep the content of hydrogen in the range described above. The content of hydrogen in the surface layer 407 can be controlled by the flow rate of raw material gas, the temperature of the substrate, the electric discharge power, the gas pressure and the like.

In addition, by performing control so that the content of fluorine in the surface layer 407 is 0.01 atomic % or greater, occurrence of linkages between silicon atoms and carbon atoms in the surface layer can be achieved more effectively. Furthermore, as an action of fluorine atoms, cleavage of linkages between silicon atoms and carbon atoms due to damages by corona and the like can be prevented more effectively.

On the other hand, if the content of fluorine in the surface layer 407 is greater than 15 atomic %, the effect for achieving occurrence of linkages between silicon atoms and carbon atoms in the surface layer and the effect for preventing cleavage of linkages between silicon atoms and carbon atoms due to damages by corona and the like are hardly exhibited. Furthermore, excessive fluorine atoms inhibit traveling of a carrier in the surface layer, and therefore remaining potentials and image memories becomes prominent. Therefore, it is one of important factors in achieving excellent desired electrophotographic characteristics to perform control to keep the content of fluorine in the range described above. The content of fluorine in the surface layer 407 can be controlled by the flow rate of raw material gas, the temperature of the substrate, the electric discharge power, the gas pressure and the like as with the content of hydrogen.

Furthermore, in the present invention, atoms for controlling a conductivity may be incorporated in the surface layer 407 as required. The atoms for controlling a conductivity may be evenly distributed in the surface layer, or may be partially unevenly distributed in the direction of thickness.

The atoms for controlling a conductivity may include so called impurities in the semiconductor field, and atoms of Group 13 or Group 15 of the periodic table may be used as such atoms.

Desirably the thickness of the surface layer 407 is usually 0.01 to 3 μm, preferably 0.05 to 2 μm, most preferably 0.1 to 1 μm. If the thickness of the layer is less than 0.01 μm, the surface layer 407 is lost due to abrasion during use of the photosensitive member, and if the thickness of the layer is greater than 3 μm, some degradation of electrophotographic characteristics such as an increase in remaining potentials is caused.

For forming the surface layer 407 having characteristics capable of achieving the object, the temperature of the substrate (Ts) and the gas pressure in the reaction vessel should be appropriately selected as desired. The optimum range of the temperature of the substrate (Ts) is determined as appropriate according to a layer design, but usually the temperature is preferably 150 to 350° C., more preferably 180 to 330° C., most preferably 200 to 300° C.

The optimum range of the pressure in the reaction vessel is similarly selected as appropriate according to a layer design, but the pressure is usually $1\times10^{-2}$ to $1\times10^{3}$ Pa, preferably $5\times10^{-2}$ to $5\times10^{2}$ Pa, most preferably $1\times10^{-1}$ to $1\times10^{2}$ Pa.

For the raw material gas for use in formation of the surface layer, a raw material gas for use in formation of the upper blocking layer may be used.

A surface layer constituted by a non-single crystal material having carbon atoms as a base material is contained in the second layer of the present invention.

The non-single crystal carbon described herein mainly refers to amorphous carbon having a nature midway between black lead (graphite) and diamond, but may partially include a microcrystal and a multicrystal.

The surface layer has a free surface, and is provided for the purpose of achieving the object of the present invention such as prevention of melt-adhesion, scares and wear-out over a long time period.

The same effect can be achieved even if the surface layer contains more or less impurities. For example, even if the surface layer contains impurities such as Si, N, O, P, B and the like, the effect of the present invention can sufficiently be achieved as long as the content of impurities is about 10 atomic % or less with respect to the total amount of atoms.

Hydrogen atoms are contained in the surface layer. By incorporating hydrogen atoms in the surface layer, structural defects in the film are effectively alleviated to reduce the localized level density, and therefore the film transparence is improved so that undesired light absorption is inhibited to improve an optical sensitivity in the surface layer. Furthermore, it is said that hydrogen atoms existing in the film plays an important role for maintaining solid wettability.

The content of hydrogen atom contained in the film of the surface layer is preferably 41 atomic % to 60 atomic %, more preferably 45 atomic % to 50 atomic % in H/(C+H). If the content of hydrogen is less than 41 atomic %, the optical band gap is reduced, resulting in an unsatisfactory sensitivity. Furthermore, if the content of hydrogen is greater than 60 atomic %, the hardness is reduced and as a result, chipping tends to occur. Generally, the value of the optical band gap is preferably about 1.2 eV to 2.2 eV, more preferably 1.6 eV or greater in terms of sensitivity. A preferable refractivity is about 1.6 to 2.8.

The thickness of the surface layer is determined in such a manner that an interference degree is measured by a reflecting spectrographic interferometer (MCPD 2000 manufactured by Otsuka Electronics Co., Ltd.), and the film thickness is calculated from the measured value and a refractivity. The thickness of the surface layer described later can be adjusted by film forming conditions and the like. The thickness is 5 nm to 2000 nm, preferably 10 nm to 100 nm. If the thickness is less than 5 nm, it becomes difficult to achieve an effect in long-time use. If the thickness is greater than 2000 nm, demerits such as a reduction in photosensitivity and remaining potentials should be considered, and therefore the thickness is more preferably 2000 nm or less.

The surface layer may be formed by a known thin film deposition method such as a glow discharge method, sputtering method, vacuum deposition method, ion plating method, photo-assisted CVD method or thermal CVD method, for example. The thin film deposition method is selected and employed as appropriate according to factors such as production conditions, the bearing level of capital investment, the production scale and characteristics desired for the electrophotographic photosensitive member for electrophotographic apparatus to be produced, but a deposition method equivalent to that for the photoconductive layer is preferable in terms of productivity of the electrophotographic photosensitive member.

For the high frequency power for decomposing a raw material gas, the higher the power, the more preferable because the higher the power, more sufficiently a hydrocarbon is decomposed, and specifically the electrical quantity (W) per unit volume (ml) of raw material gas for a unit time (min) under normal conditions (normal) is preferably 5W·min/ml (normal) or greater, but if the power is too high, abnormal discharge occurs to deteriorate characteristics of the electrophotographic photosensitive member, and it is therefore necessary to reduce the power to a level such that abnormal discharge no longer occurs.

Furthermore, for the electric discharge frequency for use in the plasma CVD method for forming the surface layer, any frequency may be used and from an industrial viewpoint, either a high frequency of 1 MHz to less than 50 MHz called an RF frequency band or high frequency of 50 MHz to 450 MHz called a VHF frequency band may be suitably used.

Furthermore, the pressure of the discharge space when the surface layer is formed is kept at 13.3 Pa to 1333 Pa (0.1 Torr to 10 Torr) when a usual RF (typically 13.52 MHz) power is used, and kept at 0.133 Pa to 13.3 Pa (0.1 mTorr to 100 mTorr) when a VHF band (typically 50 to 450 MHz) is used, but it is desirable that the pressure is kept to a minimum.

Furthermore, the temperature of the conductive substrate (Ts) when the surface layer is formed is adjusted to be a room temperature to 400° C., but if the temperature of the substrate is too high, the band gap decreases to cause a reduction in transparency, and therefore a lower temperature is preferably set.

Figure 5:
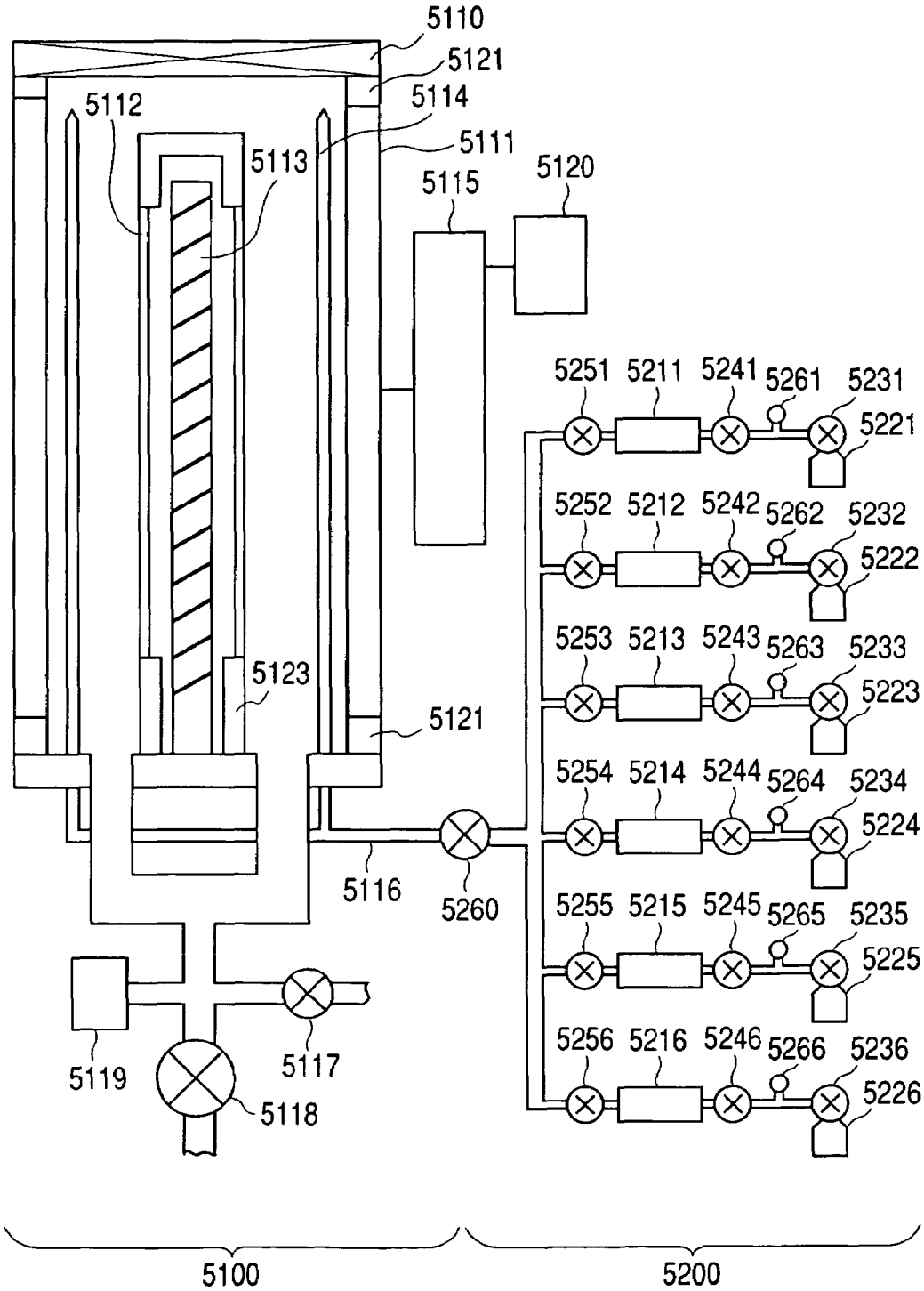
FIG. 5 is a schematic sectional view of an a-Si photosensitive member film forming apparatus using an RF.

The above described ranges are desired ranges of the substrate temperature and the gas pressure for forming the surface layer 407, but the conditions are not usually determined independently, and optimum values are desirably determined based on mutual and organic correlation for forming a photosensitive member having desired characteristics. a-Si photosensitive member film forming apparatus according to the invention FIG. 5 schematically shows one example of a photosensitive member film forming apparatus with an RF plasma CVD method using a high frequency power supply.

The apparatus is constituted mainly by a film forming apparatus 5100, a raw material gas supplying apparatus 5200, an exhaust apparatus (not shown) for reducing a pressure in a film forming apparatus 5110. A substrate 5112 connected to ground, a heater 5113 for heating the substrate and a raw material gas introduction pipe 5114 are installed in the film. forming apparatus 5110 in the film forming apparatus 5100, and a high frequency power supply 5120 is connected thereto through a high frequency matching box 5115.

The raw material gas supplying apparatus 5200 is constituted by raw material gas cylinders 5221 to 5226 of $SiH_4$, $H_2$, $CH_4$, NO, $B_2H_6$, $CF_4$ and the like, valves 5231 to 5236, 5241 to 5246 and 5251 to 5256, and mass flow controllers 5211 to 5216, and the cylinders of constituent gases are connected to the gas introduction pipe 5114 in the film forming apparatus 5110 through a valve 5260. The substrate 5112 is placed on a conductive pad 5123, thereby being connected to ground.

One example of procedure of a method for forming a photosensitive member using the apparatus of FIG. 5 will be described below. The substrate 5112 is placed in the film forming apparatus 5110, and air is exhausted from the film forming apparatus 5110 by an exhaust apparatus (e.g. vacuum pump). Subsequently, control is performed to keep the substrate 5112 at a desired temperature of 200° C. to 450° C., more preferably 250° C. to 350° C. by the substrate heating heater 5113. Then, for making the raw material gas for forming the photosensitive member flow into the film forming apparatus 5110, a check is made to ensure that valves 5231 to 5236 of gas cylinders and a leak valve 5117 of the film forming apparatus are closed, a check is made to ensure that inlet valves 5241 to 5246, outlet valves 5251 to 5256 and an auxiliary valve 5260 are opened, and a main valve 5118 is opened to exhaust air from the film forming apparatus 5110 and the gas supply pipe 5116.

Thereafter, the auxiliary valve 5260 and the outlet valves 5251 to 5256 are closed at the time when a vacuum gage indicates a pressure of 0.67 mPa. The valves 5231 to 5236 are opened to introduce gases from the gas cylinders 5221 to 5226, and the pressure of each gas is adjusted to be 0.2 MPa by pressure adjusters 5261 to 5266. Then, the inlet valves 5241 to 5246 are gradually opened to introduce the gases into the mass flow controllers 5211 to 5216. After preparation for forming a film is completed according to the procedure described above, a first layer, for example a photoconductive layer is first formed on the substrate 5112.

Specifically, at the time when the temperature of the substrate 5112 reaches to a desired temperature, necessary ones of the outlet valves 5251 to 5256 and the auxiliary valve 5260 are gradually opened to introduce desired material gases from the gas cylinders 5221 to 5226 into the film forming apparatus 5110 through the gas introduction pipe 5114. Then, an adjustment is made by the mass flow controllers 5211 to 5216 so that each gas flows at a desired rate. At this time, the aperture of the main valve 5118 is adjusted making reference to the vacuum gauge 5119 so that the pressure in the film forming apparatus 5110 reaches a desired pressure of 13.3 Pa to 1330 Pa. When the internal pressure is stabilized, the high frequency power supply 5120 is adjusted to have a desired power and for example, a high frequency power of 1 MHz to 50 MHz, e.g. 13.56 MHz is supplied through the high frequency matching box 5115 to a cathode electrode 5111 to produce a high frequency glow electric charge. Each raw material gas introduced in the film forming apparatus 5110 is decomposed by this electric discharge energy, and thereby a desired first layer having silicon atoms as a main component is formed on the substrate 5112. After a desired thickness is achieved, the supply of the high frequency power is stopped, and the outlet valves 5251 to 5256 are closed to stop the introduction of the raw material gases into the film forming apparatus 5110 to complete the formation of the first layer. The first layer may have a known composition and thickness. If a lower blocking layer is formed between the first layer and the substrate, essentially the above operation may be carried out in advance.

The point is that the photosensitive member with only the first layer formed according to the above procedure is temporarily taken out from the film forming apparatus and exposed to atmospheric air. Of course, in the case of the present invention, atmospheric air or a mixture gas of oxygen and water vapor may be introduced into the film forming apparatus instead of taking the photosensitive member from the oven. If it is taken out from the film forming apparatus, a visual check for peeling and occurrence of spherical protrusions may be conducted at the same time. In addition, image inspection and potential characteristic inspection may be carried out as required.

When inspection in which the photosensitive member contacts ozone such as image inspection and potential characteristic inspection is carried out, the photosensitive member is preferably subjected to water washing or organic medium washing before a second layer is formed, and water washing is more preferable in consideration of environments in recent years. The method for washing the photosensitive member with water will be described later. By washing the photosensitive member with water before the second layer is formed in this way, adhesive properties can further be improved.

The photosensitive member exposed to atmospheric air is returned to the film forming apparatus to form the second layer containing an upper blocking layer. The second layer is formed essentially in the same manner as the formation of the first layer except that hydrocarbon gases such as $CH_4$ and $C_2H_6$ are used as the raw material gas and a diluting gas such as $H_2$ is additionally used.

Figure 6:
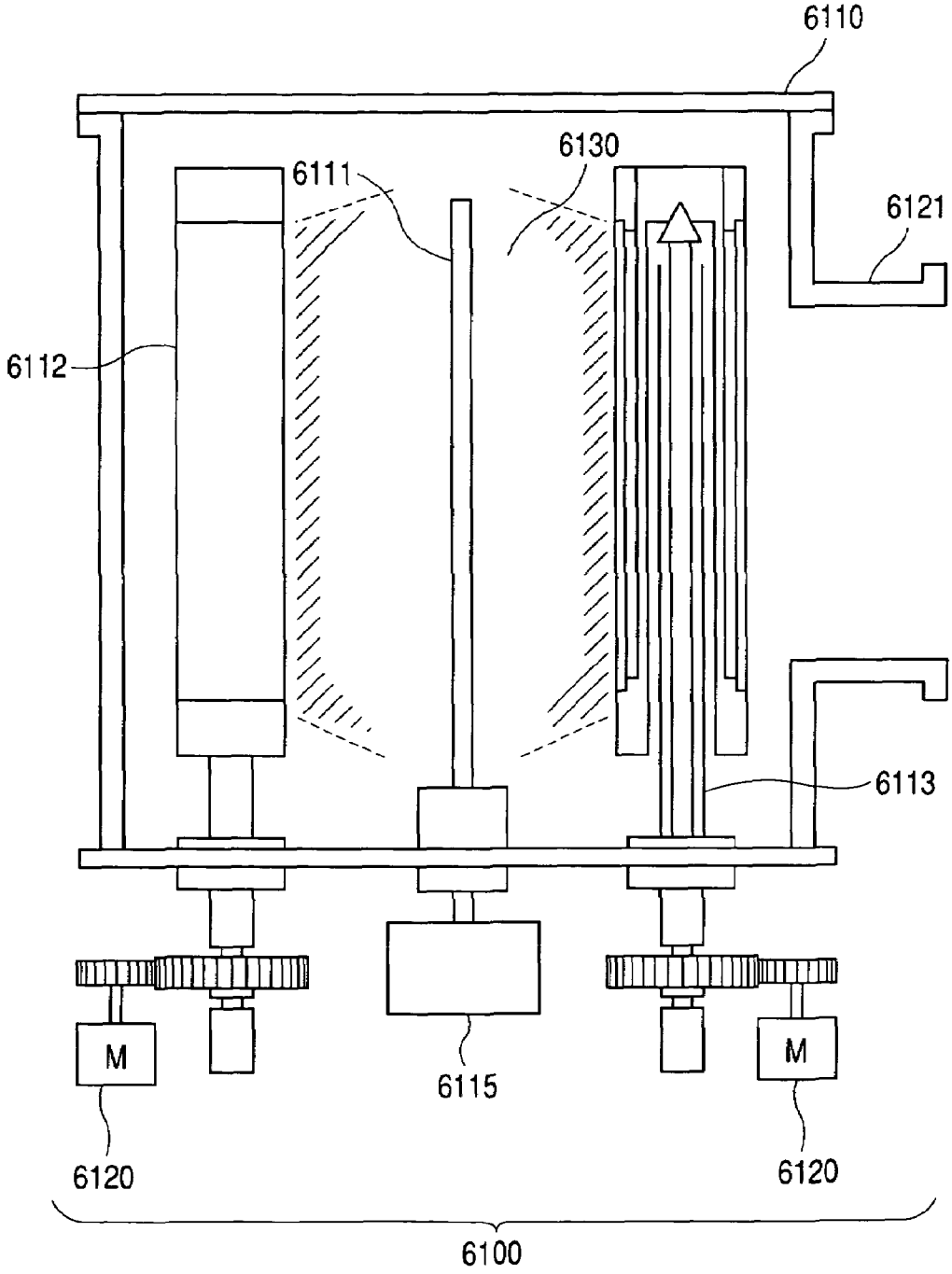
FIG. 6 is a schematic sectional view of the a-Si photosensitive member film forming apparatus using a VHF.

FIG. 6 schematically shows one example of film forming apparatus for the photosensitive member with a VHF plasma CVD method using a VHF power supply.

This apparatus has a configuration such that a film forming apparatus 6100 of FIG. 6 is used in place of the film forming apparatus 5100 shown in FIG. 5.

Formation of a deposit film in this apparatus by the VHF plasma CVD method can be performed essentially in the same manner as the RF plasma CVD method. A film forming apparatus 6110 is connected to an exhaust apparatus (not shown) through an exhaust pipe 6121, and the pressure in the film forming apparatus 6110 is kept at 13.3 mPa to 1330 Pa, namely a level lower than that of the RF plasma CVD method. A high frequency power of 50 MHz to 450 MHz, e.g. of 105 MHz is supplied from a VHF power supply to a cathode electrode 6111 through a matching box 6115. A substrate 6112 is heated by a substrate heating heater 6113, and is rotated at a desired rotation speed by a substrate rotating motor 6120 for forming the layer uniformly. The introduced raw material gas is exited and dissociated by discharge energy in a discharge space 6130 surrounded by the substrate 6112, whereby a predetermined deposit film is formed on the substrate 6112.

Surface Polishing Apparatus According to the Present Invention

Figure 7:
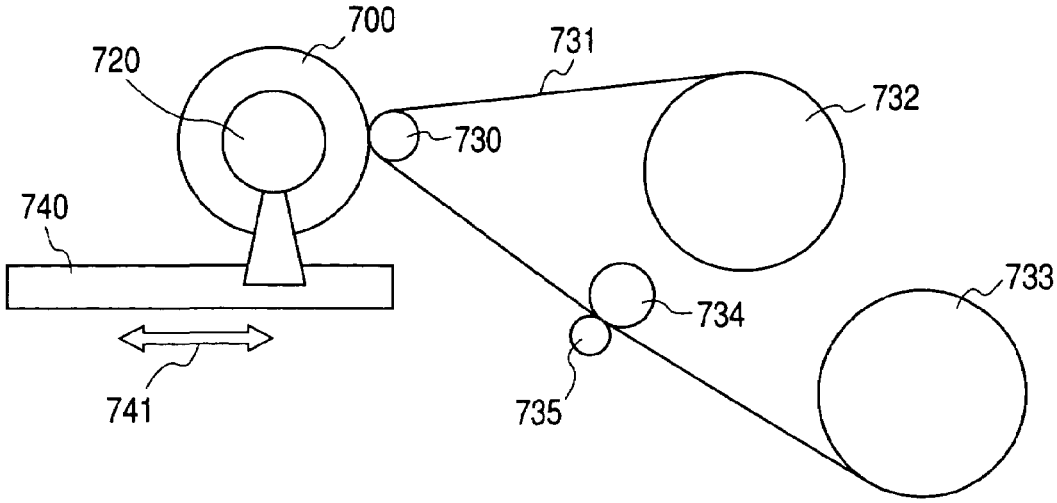
FIG. 7 is a schematic sectional view of a surface polishing apparatus used in the present invention.

FIG. 7 shows one example of surface polishing apparatus for use in surface processing, specifically one example of surface polishing apparatus for use in performing polishing as surface processing in the process of producing the electrophotographic photosensitive member of the present invention. In the example of a configuration of the surface polishing apparatus shown in FIG. 7, a processing object (surface of deposit film on cylindrical substrate) 700 is a cylindrical substrate having deposited on its surface a first layer composed of a-Si, and is attached to an elastic support mechanism 720. In the apparatus shown in FIG. 7, for example, a pneumatic holder, specifically a pneumatic holder manufactured by Bridgestone Co., Ltd. (trade name: Air Pick, model: PO45TCA*820) is used for the elastic support mechanism 720. A press elastic roller 730 presses a polishing tape 731 against the surface of the a-Si photoconductive layer of the processing object 700. The polishing tape 731 is supplied from an unwinding roll 732 and collected by a winding roll 733. The unwinding speed is adjusted by a quantitative unwinding roll 734 and a capstan roller 735, and its tension is also adjusted. For the polishing tape 731, usually so called a wrapping tape is suitably used. When a surface of an intermediate layer such as the first layer or upper blocking layer of the photoconductive layer or the like composed of a non-single crystal material such as a-Si is processed, SiC, $Al_2O_3$, $Fe_2O_3$ or the like is used as a polishing powder for the polishing tape.

Specifically, a Wrapping tape LT-C 2000 manufactured by Fuji Photo Film Co., Ltd. was used. The press elastic roller 730 has a roller part made of material such as neoprene and silicon rubber, which should have a JIS rubber hardness of 20 to 80, more preferably 30 to 40. Furthermore, the shape of the roller part is preferably such that the diameter of the middle portion is slightly larger than the diameters of both ends in the longitudinal direction, and for example, the difference in diameter between the former and the latter is in the range of 0.0 to 0.6 mm, more preferably 0.2 to 0.4 mm. The press elastic roller 730 presses the rotating processing object (surface of deposit film on cylindrical substrate) 700 with a pressure of 0.05 MPa to 0.2 MPa while sending the polishing tape 731, e.g. the wrapping tape described above to polish the surface of the deposit film.

Furthermore, for surface polishing carried out in the atmosphere, means of wet polishing such as buff polishing can be used instead of means of using the polishing tape described above. Furthermore, when the means of wet polishing is used, a step of washing away a liquid used in polishing after polishing processing is provided, and at this time, processing for washing the surface by making the surface contact water can be carried out at the same time.

Means for observing surface roughness before and after surface processing in process of producing photographic photosensitive member of the invention In the electrophotographic photosensitive member of the present invention, a second layer is deposited on the surface of the first layer subjected to surface processing. At this time, it is preferable that processing is carried out so that the surface roughness is reduced to a specific level or lower as a result of surface processing, e.g. polishing.

A microscopic change in the surface before and after this surface processing requires observation of a change in more microscopic surface structure unlike macroscopic surface roughness. By making evaluations of the change in microscopic surface structure, conditions for surface processing can be made more appropriate in the process of producing the electrophotographic photosensitive member of the present invention.

Specifically, as means for observing a substantial surface structure before and after surface polishing, a change in surface in an atomic level is preferably checked using, for example, an interatomic force microscope (AFM), specifically a commercially available interatomic force microscope (AFM) [Q-Scope 250 manufactured by Quesant Co., Ltd.]. The reason why observation means having such a high resolution as that of the interatomic force microscope (AFM) is used is that it is more important to appropriately check existence/nonexistence of a change in normal portion caused by surface processing, e.g. polishing, focusing on a finer roughness associated with the deposit film itself such as the photoconductive layer and the intermediate layer, not a roughness in an order of several 100 nm, which is dependent on the surface roughness of the used cylindrical substrate itself.

The fine roughness can be measured with high accuracy and in good reproducibility by, for example, reducing the measurement range to 10 μm×10 μm and avoiding a systematic error caused by a curvature tilt of the sample surface by AMF. Specific examples include a correction (parabolic) such that the tilt removal mode is selected as a measurement mode of the Q-Scope 250 manufactured by Quesant Co., Ltd. to match the curvature of the AFM image of the sample with a parabola, and thereafter the surface is flattened. The surface of the electrophotographic photosensitive member is approximately cylindrical, and therefore the observation method using the flattening correction is considered as a suitable method. Furthermore, if the tilt remains on the entire image, a correction is made (line by line) to remove the tilt. In this way, the tilt of the sample surface is corrected as appropriate without causing data to be deformed, whereby information of finer roughness associated with a desired deposit film itself.

Water Washing Apparatus According to the Invention

The water washing is disclosed in, for example, Japanese Patent No. 2786756 (corresponding to U.S. Pat. No. 5,314,780). One example of water washing apparatus capable of being used in the present invention is shown in FIG. 8.

Figure 8:
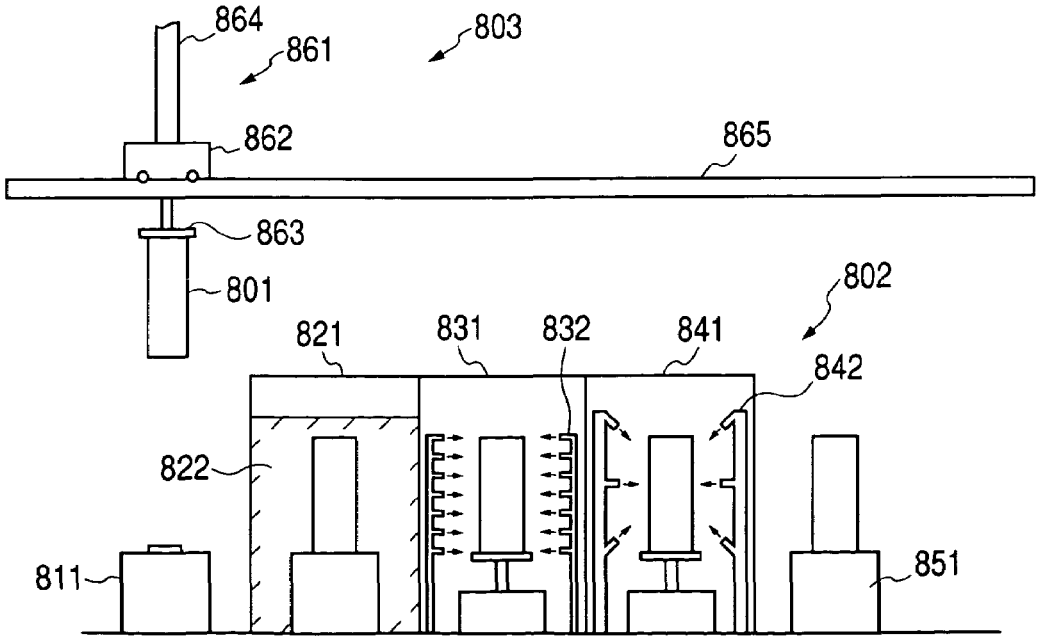
FIG. 8 is a schematic sectional view of water washing apparatus used in the present invention.

The water washing apparatus shown in FIG. 8 is constituted by a processing unit 802 and a processing object member conveying mechanism 803. The processing unit 802 is constituted by a processing object member introducing stand 811, processing object member washing tank 821, a pure water contact tank 831, a drying tank 841 and a processing object member carry-out stand 851. The washing tank 821 and pure water contact tank 831 are each provided with a temperature regulating apparatus (not shown) for keeping the liquid temperature constant. The conveying mechanism 803 is constituted by a conveyance rail 865 and a conveyance arm 861, and the conveyance arm 861 is constituted by a traveling mechanism 862 traveling on the rail 865, a catching mechanism 863 holding a substrate 801 and an air cylinder 864 for moving the catching mechanism 863 up and down. The substrate 801 placed on the introducing stand 811 is conveyed to the washing tank 821 by the conveying mechanism 803. The substrate 801 is subjected ultrasonic processing in a washing liquid 822 constituted by an aqueous surfactant solution in the washing tank 821, whereby an oil and a powder deposited on the surface are washed away. Then, the substrate 801 is conveyed to the pure water contact tank 831 by the conveying mechanism 803, where pure water with the resistivity of 175 kΩ·m (17.5 MΩ·cm) kept at a temperature of 25° C. is sprayed through a nozzle 832 to the substrate 801 with a pressure of 4.9 MPa. The substrate 801 after the pure water contact step is moved to the drying tank 841 by the conveying mechanism 803, where a pressurized high temperature air is blown though a nozzle 842 to the substrate 801 to be dried. The substrate 801 after the drying step is conveyed to the carry-out stand 851 by the carrying mechanism 803.

Electrophotographic Apparatus According to the Invention

Figure 9:
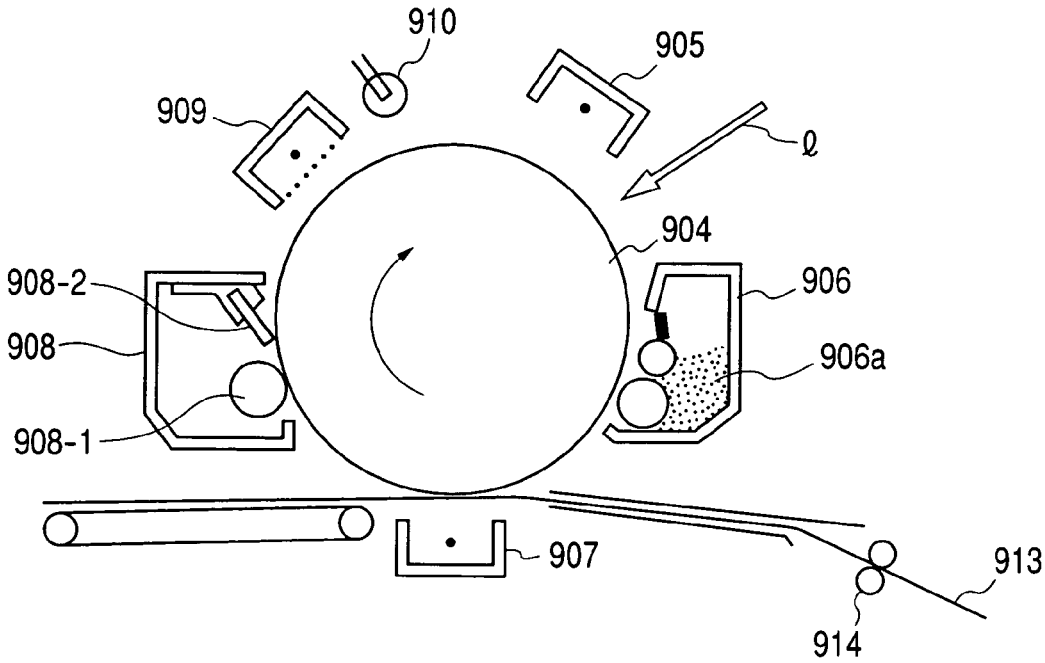
FIG. 9 is a schematic sectional diagram of one example of an electrophotographic apparatus using a corona charging system.

One example of electrophotographic apparatus using the electrophotographic photosensitive member of the present invention is shown in FIG. 9. Furthermore, the apparatus of this example is suitable when a cylindrical electrophotographic photosensitive member is used, but the electrophotographic apparatus of the present invention is not limited to this example, and the photosensitive member may have a desired shape such as an endless belt.

In FIG. 9, reference numeral 904 denotes an electrophotographic photosensitive member in the present invention, and reference numeral 905 denotes a primary charging device electrifying the photosensitive member 904 for forming an electrostatic latent image. Reference numeral 906 denotes a developing device for supplying a developer (toner) 906*a* to the photosensitive body 904 with the electrostatic latent image formed thereon, and reference numeral 907 denotes a transfer charging device for transferring the toner on the surface of the photosensitive member to a developing material. Reference numeral 908 denotes a cleaner for cleaning the surface of the photosensitive member. In this example, an elastic roller 908-1 and a cleaning blade 908-2 are used to clean the surface of the photosensitive member for uniformly cleaning the surface of the photosensitive member effectively, but a configuration having any one of them or having no cleaner 908 can be designed. Reference numerals 909 and 910 are an AC static eliminator and a static elimination lamp, respectively, for eliminating static electricity on the surface of the photosensitive member for the subsequent copy operation, but a configuration with any one or both of them being absent can be designed as a matter of course. Reference numeral 913 denotes a transferring material such as paper, and reference numeral 914 denotes an unwinding roller for the transferring material. For the light source for light exposure 1, a light source such as a halogen light source, or a laser or LED having mainly a single wavelength is used.

Using this apparatus, a copy image is formed as follows.

First, the electrophotographic photosensitive member 904 is rotated in the direction shown by the arrow at a predetermined speed, and a primary charging device 905 is used to uniformly electrify the surface of the photosensitive member 904. Then, light exposure 1 of an image is performed on the electrified surface of the photosensitive member 904 to form an electrostatic image of the image on the surface of the photosensitive member 904. Then, when the portion of the surface of the photosensitive member 904 on which the electrostatic latent image is formed passes through an area on which the developing device 906 is placed, the toner is supplied to the surface of the photosensitive member 904 by the developing device 906, the electrostatic latent image is developed as an image by the toner 906*a*, the toner image arrives at an area on which the transfer charging device 907 is placed as the photosensitive member 904 is rotated, and in this area, the toner image is transferred to the transferring material 913 conveyed by the unwinding roller 914.

After the toner is transferred, a residual toner is removed from the surface of the electrophotographic photosensitive member 904 by the cleaner 908 for the subsequent copy step, and static electricity is eliminated so that the potential of the surface is reduced to zero or almost zero by the eliminator 909 and the elimination lamp 910, thus completing one copy step.

Since there exist a large number of localized levels in the electrophotographic photosensitive member (904), part of a light carrier is captured in the localized carrier, and thus its traveling characteristics are degraded, or the recombination probability of the light carrier is reduced. As a result, the light carrier generated by light exposure of image information remains in the photosensitive member until the subsequent charging step is started, and is released from the localized level during the charging step or afterward. Consequently, there arises a difference in surface potential of the photosensitive member between a light exposure portion and a non-light exposure portion, and finally this tends to appear as an image forming hysterisis (hereinafter referred to as ghost) associated with an optical memory.

Thus, in the electrophotographic apparatus using a conventional electrophotographic photosensitive member (904), static eliminating light is provided for eliminating such a ghost. Since aspects of improvement of charging efficiency and reduction of potential shifts and the like are badly influenced if the optical memory erasing capability is enhanced at random, an LED array capable of strictly controlling the wavelength and the amount of light is generally used as a static eliminating light source.

EXAMPLES

The present invention will be described below based on Examples with reference to Comparative Examples.

Example A-1

An a-Si photosensitive member forming apparatus shown in FIG. 5 was used to form a photoconductive layer as a first layer on an Al substrate with the diameter of 108 mm under conditions shown in Table A-1.

TABLE A-1

| Gas type and flow rate | Photoconductive layer |
|---|---|
| $SiH_4$ {ml/min (normal)} | 400 |
| $H_2$ {ml/min (normal)} | 400 |
| Substrate temperature {° C.} | 240 |
| Pressure in reactive vessel {Pa} | 67 |
| High frequency power {W} | 500 |
| Film thickness {μm} | 25 |

Then, the substrate with the first layer formed thereon was temporarily taken out from a film forming apparatus and exposed to atmospheric air. The substrate was left standing in atmospheric air for 5 minutes, and thereafter the substrate was returned to the film forming apparatus, where an upper blocking layer and a surface layer both being a second layer were deposited under conditions shown in Table A-2.

TABLE A-2

| Gas type and flow rate | Upper blocking layer | Surface layer |
|---|---|---|
| $SiH_4$ {ml/min (normal)} | 200 | 50 |
| $B_2H_6$ {ppm} (vs. $SiH_4$) | 1000 | — |
| $CH_4$ {ml/min (normal)} | 200 | 500 |
| Substrate temperature {° C.} | 240 | 240 |
| Pressure in reactive vessel {Pa} | 67 | 67 |
| High frequency power {W} | 300 | 300 |
| Film thickness {μm} | 0.3 | 0.5 |

The photosensitive member obtained according to the procedure described above, which is a photosensitive member for use in negative chare, was evaluated as follows.

Number of Spherical Protrusions

The surface of the photosensitive member was observed by an optical microscope. Then, the number of spherical protrusions with the size of 20 μm or greater was counted, and the number of such spherical protrusions per 10 $cm^2$ was measured.

The obtained results were rated based on relative comparison with the value in Comparative Example A-2 defined as 100%.

A: Equal to or greater than 35% and less than 65%.

B: Equal to or greater than 65% and less than 95%.

C: Equivalent to Comparative Example A-2.

Image Defects

The electrophotographic photosensitive member fabricated in this Example was mounted on an electrophotographic apparatus having a corona discharging device as a primary charging device and comprising a cleaning blade in a cleaner to form an image. Specifically, GP605 manufactured by Canon Inc. (process speed: 300 mm/sec, image exposure) as a base was modified so that negative charge was possible, and a copier using a negative toner instead of a toner was used as a test electrophotographic apparatus to copy a plain white sheet of A3 size. An image obtained in this way was observed to count the number of black spots caused by spherical protrusions with the diameter of 0.3 mm or greater.

The obtained results were rated based on relative comparison with the value in Comparative Example A-2 defined as 100%.

A: Equal to or greater than 35% and less than 65%.

B: Equal to or greater than 65% and less than 95%.

C: Equivalent to Comparative Example A-2.

Charge Capability

The electrophotographic photosensitive member is placed in the electrophotographic apparatus shown in FIG. 9, a high voltage of +6 kV (in a case of positive charging) or −6 kV (in a case of negative charging) is applied to a charging device to carry out corona charging, and the dark area surface potential of the electrophotographic photosensitive member is measured by a surface potentiometer placed at a location of the developing device.

The obtained results were rated based on relative comparison with the value in Comparative Example A-2 defined as 100%.

AA: Equal to or greater than 125%

A: Equal to or greater than 115% and less than 125%.

B: Equal to or greater than 105% and less than 115%.

C: Equivalent to Comparative Example A-2.

Remaining Potential

The electrophotographic photosensitive member is electrified to have a certain dark area surface potential (e.g. 450V). Then, the electrophotographic photosensitive member is immediately irradiated with a fixed amount of relatively intense light (e.g. 1.5 Lx·sec). At this time, the remaining potential of the electrophotographic photosensitive member is measured by a surface potentiometer placed at a location of the developing device.

The obtained results were rated based on relative comparison with the value in Comparative Example A-2 defined as 100%.

A: Less than 85%.

B: Equal to or greater than 85% and less than 95%.

C: Equivalent to Comparative Example A-2.

The results of comprehensive evaluation conducted as described above are shown in Table A-4 along with the results of Comparative Example A-1.

Comparative Example A-1

Using an a-Si photosensitive member forming apparatus shown in FIG. 5, a photoconductive layer as a first layer was deposited on a cylindrical Al substrate with the diameter of 108 mm under conditions shown in Table A-1 and subsequently, an upper block layer and a surface layer as a second layer were deposited under conditions shown in Table A-2 without exposing the substrate to atmospheric air.

The negative charging photosensitive member fabricated as described above was evaluated in the same manner as Example A-1, and the results are shown in Table A-4.

Comparative Example A-2

Using an a-Si photosensitive member forming apparatus shown in FIG. 5, a photoconductive layer as a first layer and a surface layer as a second layer were continuously deposited on a cylindrical Al substrate with the diameter of 108 mm under conditions shown in Table A-3 without exposing the substrate to atmospheric air. In this Comparative Example, the upper blocking layer for the second layer was not provided.

The negative charging photosensitive member fabricated as described above was evaluated in the same manner as Example A-1, and the results are shown in Table A-4.

TABLE A-3

| Gas type and flow rate | Photoconductive layer | Surface layer |
|---|---|---|
| $SiH_4$ {ml/min (normal)} | 400 | 50 |
| $H_2$ {ml/min (normal)} | 400 | — |
| $CH_4$ {ml/min (normal)} | | 500 |
| Substrate temperature {° C.} | 240 | 240 |
| Pressure in reactive vessel {Pa} | 67 | 67 |
| High frequency power {W} | 500 | 300 |
| Film thickness {μm} | 25 | 0.5 |

TABLE A-4

| | Example A-1 | Comparative Example A-1 | Comparative Example A-2 |
|---|---|---|---|
| Evaluation | | | |
| Number of spherical protrusions | C | C | C |
| Image defects (number of spots) | B | C | C |
| Charge capability | A | A | C |
| Remaining potential | A | A | C |

As apparent from Table A-4, the photosensitive member of the present invention is equivalent to Comparative Examples A-1 and A-2 in the number of spherical protrusions, but is considerably improved in the number of spots representing image defects. In addition, it can be understood that provision of the upper blocking layer results in improvements in charge capability and remaining potential, and the characteristics of the photosensitive member are not adversely affected even if the photosensitive member is temporarily exposed to atmospheric air after the first layer is formed and before the second layer is formed.

Example A-2

An a-Si photosensitive member forming apparatus shown in FIG. 5 was used to produce a photosensitive member having a photoconductive layer formed as a first layer on a cylindrical Al substrate with the diameter of 108 mm under conditions shown in Table A-5.

TABLE A-5

| Gas type and flow rate | Lower blocking layer | Photoconductive layer |
|---|---|---|
| $SiH_4$ {ml/min (normal)} | 100 | 100 |
| $H_2$ {ml/min (normal)} | 100 | 100 |
| $B_2H_6$ {ppm} (vs. $SiH_4$) | 500 | 0.3 |
| NO {ml/min (normal)} | 10 | — |
| Substrate temperature {° C.} | 200 | 200 |
| Pressure in reactive vessel {Pa} | 0.8 | 0.8 |
| High frequency power {W} | 300 | 300 |
| Film thickness {μm} | 3 | 30 |

Then, in this state, air was introduced into a film forming apparatus through a leak valve to expose the photosensitive member to atmospheric air. After the photosensitive member was left standing in this state for 5 minutes, the film forming apparatus was decompressed again to deposit an upper blocking layer as a second layer under conditions shown in Table A-6.

TABLE A-6

| Gas type and flow rate | Upper blocking layer |
|---|---|
| $SiH_4$ {ml/min (normal)} | 200 |
| $PH_3$ {PPm} (vs. $SiH_4$) | 1000 |
| $CH_4$ {ml/min (normal)} | 200 |
| Substrate temperature {° C.} | 240 |
| Pressure in reactive vessel {Pa} | 67 |
| High frequency power {W} | 300 |
| Film thickness {μm} | 0.3 |

The photosensitive member fabricated according to the procedure described above, which is a photosensitive member for use in positive charge, was evaluated in the same manner as Example A-1 using as a test electrophotographic apparatus a copier based on GP605 manufactured by Canon Inc., and the results are shown in Table A-7.

Comparative Example A-3

An a-Si photosensitive member forming apparatus shown in FIG. 5 was used to produce a photosensitive member having a photoconductive layer formed as a first layer on a cylindrical Al substrate with the diameter of 108 mm under conditions shown in Table A-5. Then, in this state, $O_2$ gas was introduced into a film forming apparatus to an atmospheric pressure to expose the photosensitive member to an oxygen atmosphere. After the photosensitive member was left standing in this state for 5 minutes, the film forming apparatus was decompressed again to deposit an upper blocking layer as a second layer under conditions shown in Table A-6.

The positive charging photosensitive member fabricated as described above was evaluated in the same manner as Example A-1, and the results are shown in Table A-7 along with the results of Example A-2.

TABLE A-7

| | Example A-2 | Comparative Example A-3 |
|---|---|---|
| Evaluation | | |
| Number of spherical protrusions | C | C |
| Image defects (number of spots) | B | C |
| Charge capability | A | A |
| Remaining potential | A | A |

As apparent from Table A-7, the effect of the present invention is achieved by merely exposing the photosensitive member to atmospheric air in the film forming apparatus. Furthermore, it is estimated that the effect is not associated simply with oxidization of the surface but with some interaction with atmospheric air, water vapor or the like from the fact that no effect was found even though the photosensitive member was exposed to an oxygen atmosphere.

Example A-3

An a-Si photosensitive member forming apparatus of VHF plasma CVD system shown in FIG. 6 was used to produce a photosensitive member having a lower blocking layer and a photoconductive layer deposited as a first layer on a cylindrical Al substrate with the diameter of 108 mm under conditions described Table A-8.

TABLE A-8

| Gas type and flow rate | Lower blocking layer | Photoconductive layer |
|---|---|---|
| $SiH_4$ {ml/min (normal)} | 200 | 200 |
| $PH_3$ {ppm} (vs. $SiH_4$) | 1500 | 1.0 |
| NO {ml/min (normal)} | 10 | — |
| Substrate temperature {° C.} | 200 | 200 |
| Pressure in reactive vessel {Pa} | 0.8 | 0.8 |
| High frequency power {W} | 1000 | 2000 |
| Film thickness {μm} | 3 | 30 |

Then, the substrate with the first layer deposited thereon was temporarily taken out from a film forming apparatus and exposed to atmospheric air, and was thereafter returned to the film forming apparatus to deposit an upper blocking layer and a surface layer as a second layer under conditions shown in Table A-9.

TABLE A-9

| Gas type and flow rate | Upper blocking layer | Surface layer |
|---|---|---|
| $SiH_4$ {ml/min (normal)} | 100 | 50 |
| $B_2H_6$ {ppm} (vs. $SiH_4$) | 3000 | — |
| $CH_4$ {ml/min (normal)} | 50 | 100 |
| Substrate temperature {° C.} | 200 | 200 |
| Pressure in reactive vessel {Pa} | 0.8 | 0.8 |
| High frequency power {W} | 500 | 500 |
| Film thickness {μm} | 0.5 | 0.5 |

The negative charging photosensitive member fabricated as described above was evaluated in the same manner as Example A-1. The results are shown in Table A-10 along with the results of Example A-4.

Example A-4

The a-Si photosensitive member forming apparatus of VHF plasma CVD system shown in FIG. 6 was used to produce a photosensitive member having a lower blocking layer and a photoconductive layer deposited as a first layer on a cylindrical Al substrate with the diameter of 108 mm under conditions described Table A-8.

Then, the substrate with the first layer deposited thereon was temporarily taken out from a film forming apparatus and exposed to atmospheric air. In this Example, at this time, a polishing apparatus shown in FIG. 7 was used to polish the surface to flatten projection portions of spherical protrusions. Projection portions of spherical protrusions of the surface before being polished had sizes of 5 to 20 μm as observed by a laser microscope, but their sizes were reduced to 2 μm or smaller by this flattening process.

Then, the surface was washed using a water washing apparatus shown in FIG. 8. Thereafter, the substrate was returned to the film forming apparatus to deposit an upper blocking layer and a surface layer as a second layer on the polished first layer under conditions shown in Table A-9.

The negative charging photosensitive member fabricated as described above was evaluated in the same manner as Example A-1. The results are shown in Table A-10 along with the results of Example A-3.

TABLE A-10

| | Example A-3 | Example A-4 |
|---|---|---|
| Evaluation | | |
| Number of spherical protrusions | C | C |
| Image defects (number of spots) | B | A |
| Charge capability | A | A |
| Remaining potential | A | A |

It can be understood from Table A-10 that the effect of the present invention is similarly achieved even with a production method using a VHF system. Furthermore, it has been found that the image defect reduction effect is enhanced if a second layer is formed after projection portions of spherical protrusions are flattened.

Example A-5

The a-Si photosensitive member forming apparatus shown in FIG. 5 was used to produce a photosensitive member having a lower blocking layer and a photoconductive layer deposited as a first layer on a cylindrical Al substrate with the diameter of 108 mm under conditions described Table A-11.

TABLE A-11

| Gas type and flow rate | Lower blocking layer | Photo-conductive layer |
|---|---|---|
| $SiH_4$ {ml/min (normal)} | 100 | 500 |
| $H_2$ {ml/min (normal)} | 300 | 1000 |
| $PH_3$ {ppm} (vs. $SiH_4$) | 3000 | 0.5 |
| NO {ml/min (normal)} | 5 | — |
| Substrate temperature {° C.} | 290 | 290 |

TABLE A-11-continued

| Gas type and flow rate | Lower blocking layer | Photo-conductive layer |
|---|---|---|
| Pressure in reactive vessel {Pa} | 76 | 76 |
| High frequency power {W} | 100 | 350 |
| Film thickness {μm} | 5 | 30 |

Then, the substrate with the first layer deposited thereon was temporarily taken out from a film forming apparatus and exposed to atmospheric air. The substrate was left standing in atmospheric air for 10 minutes, and was thereafter washed using the water washing apparatus shown in FIG. 8. Thereafter, the substrate was returned to the film forming apparatus to deposit an upper blocking layer and a surface layer as a second layer on the first layer under conditions shown in Table A-12. In this Example, photosensitive members A-5A to A-5F having different thicknesses of upper blocking layers due to variation of time spent for forming the upper blocking layer were fabricated.

TABLE A-12

| Gas type and flow rate | Upper blocking layer | Surface layer |
|---|---|---|
| $SiH_4$ {ml/min (normal)} | 100 | 50 |
| $B_2H_6$ {ppm} (vs. $SiH_4$) | 10000 | — |
| $CH_4$ {ml/min (normal)} | 500 | 500 |
| Substrate temperature {° C.} | 240 | 240 |
| Pressure in reactive vessel {Pa} | 76 | 76 |
| High frequency power {W} | 300 | 100 |
| Film thickness {μm} | 0.001 to 2 | 0.5 |

The negative charging photosensitive member obtained according to the procedure described above was evaluated in the same manner as Example A-1, and evaluations were made for the size of spherical protrusions. The entire surface of the obtained photosensitive member was observed by an optical microscope to measure an approximate diameter of the largest spherical protrusion. As a result, it was found that the diameter is about 100 μm for any photosensitive member under production conditions of this Example. The ratio of thickness of the upper blocking layer to the diameter of the largest spherical protrusion measured in this way was determined.

The results of evaluations are shown in Table A-13. As apparent from Table A-13, the thickness of the upper blocking layer is preferably $10^{-4}$ times or more as large as the diameter of the largest spherical protrusion for achieving the image defect reduction effect of the present invention. Furthermore, the image defect reduction effect was sufficiently achieved for the photosensitive member A-5F, but the thickness of the upper blocking layer was so large that the sensitivity was reduced. It can be thus understood that the upper limit of the thickness is desirably 1 μm or smaller. Furthermore, adhesion properties were improved by washing the substrate by a water washing apparatus before depositing the second layer.

TABLE A-13

| | | Example A-5 | | | | | |
|---|---|---|---|---|---|---|---|
| Drum number | | A-5A | A-5B | A-5C | A-5D | A-5E | A-5F |
| Thickness of upper blocking layer (μm) | | 0.001 | 0.005 | 0.01 | 0.1 | 1 | 2 |
| Ratio of thickness of upper blocking layer to diameter of largest spherical protrusion | | $1 \times 10^{-5}$ | $5 \times 10^{-5}$ | $1 \times 10^{-4}$ | $1 \times 10^{-3}$ | $1 \times 10^{-2}$ | $2 \times 10^{-2}$ |
| Evaluation | Number of spherical protrusions | C | C | C | C | C | C |
| | Image defects (number of spots) | C | C | B | B | B | B |
| | Charge capability | B | B | A | A | A | A |
| | Remaining potential | B | B | A | A | A | A |

Example A-6

The a-Si photosensitive member forming apparatus shown in FIG. 5 was used to produce a photosensitive member having a lower blocking layer and a photoconductive layer deposited as a first layer on a cylindrical Al substrate with the diameter of 108 mm under conditions described Table A-14.

TABLE A-14

| Gas type and flow rate | Lower blocking layer | Photo-conductive layer |
|---|---|---|
| $SiH_4$ {ml/min (normal)} | 100 | 100 |
| $H_2$ {ml/min (normal)} | 300 | 600 |
| $PH_3$ {ppm} (vs. $SiH_4$) | 300 | — |
| NO {ml/min (normal)} | 5 | — |
| Substrate temperature {° C.} | 260 | 260 |
| Pressure in reactive vessel {Pa} | 76 | 76 |
| High frequency power {W} | 100 | 550 |
| Film thickness {μm} | 3 | 25 |

Then, a leak valve was opened to introduce atmospheric air into a film forming apparatus while the substrate with the first layer deposited thereon was left in the film forming apparatus. The substrate was exposed to atmospheric air and left standing for about 10 minutes, and thereafter the substrate was taken out from film forming apparatus, .and was washed by the water washing apparatus shown in FIG. 8. After the substrate was washed, it was returned to the film forming apparatus, followed by decompressing the film forming apparatus, and subsequently depositing an upper blocking layer and a surface layer as a second layer on the first layer under conditions shown in Table A-15. In this Example, photosensitive members A-6G to A-6L having different contents of B (boron), i.e. impurity atom of Group 13, contained in the upper blocking layer, due to variation of the flow rate of $B_2H_6$ during deposition of the upper blocking layer were fabricated.

TABLE A-15

| Gas type and flow rate | Upper blocking layer | Surface layer |
|---|---|---|
| $SiH_4$ {ml/min (normal)} | 100 | 50 |
| $B_2H_6$ {ppm} (vs. $SiH_4$) | (Change) | — |
| $CH_4$ {ml/min (normal)} | 500 | 500 |
| Substrate temperature {° C.} | 240 | 240 |
| Pressure in reactive vessel {Pa} | 76 | 76 |
| High frequency power {W} | 300 | 100 |
| Film thickness {μm} | 0.3 | 0.5 |

The negative charging photosensitive member obtain according to the procedure described above was evaluated in the same manner as Example A-1.

After evaluations were made, each photosensitive member was cut to expose a section to carry out a SIMS analysis (secondary ion mass spectrometry), thereby measuring the content of B (boron) in the upper blocking layer.

The results of evaluations are shown in Table A-16. As apparent from Table A-16, the content of impurity in the upper blocking layer is preferably 100 ppm to 30,000 ppm. Furthermore, adhesion properties were further improved by washing the substrate by the water washing apparatus before depositing the second layer.

TABLE A-16

| | Example A-6 | | | | | |
|---|---|---|---|---|---|---|
| Drum number | A-6G | A-6H | A-6I | A-6J | A-6K | A-6L |
| Content of B in | 80 | 100 | 1000 | 10000 | 30000 | 35000 |

TABLE A-16-continued

| Example A-6 | | | | | | | |
|---|---|---|---|---|---|---|---|
| upper blocking layer (ppm) | | | | | | | |
| Evaluation | Number of spherical protrusions | C | C | C | C | C | C |
| | Image defects (number of spots) | C | B | B | B | B | C |
| | Charge capability | C | A | A | A | A | C |
| | Remaining potential | C | A | A | A | A | C |

Example A-7

The a-Si photosensitive member forming apparatus shown in FIG. 5 was used to produce a photosensitive member having a lower blocking layer and a photoconductive layer deposited as a first layer on a cylindrical Al substrate with the diameter of 108 mm under conditions described Table A-17.

TABLE A-17

| Gas type and flow rate | Lower blocking layer | Photo-conductive layer |
|---|---|---|
| $SiH_4$ {ml/min (normal)} | 350 | 350 |
| $H_2$ {ml/min (normal)} | 350 | 350 |
| $PH_3$ {ppm} (vs. $SiH_4$) | 500 | 0.5 |
| NO {ml/min (normal)} | 20 | — |
| Substrate temperature {° C.} | 250 | 250 |
| Pressure in reactive vessel {Pa} | 60 | 60 |
| High frequency power {W} | 500 | 500 |
| Film thickness {μm} | 2 | 28 |

Then, the substrate with the first layer deposited thereon was temporarily taken out from a film forming apparatus and exposed to atmospheric air. In this example, at this time, a polishing apparatus shown in FIG. 7 was used to polish the surface to flatten projection portions of spherical protrusions. Then, the surface of the photosensitive member was washed using a water washing apparatus shown in FIG. 8. Thereafter, the photosensitive member was returned to the film forming apparatus to deposit an upper blocking layer and a surface layer as a second layer under conditions shown in Table A-18. In this example, photosensitive members A-7A to A-7F having different thickness of upper blocking layer due to variation of time spent for film formation.

TABLE A-18

| Gas type and flow rate | Upper blocking layer | Surface layer |
|---|---|---|
| $SiH_4$ {ml/min (normal)} | 50 | 50 |
| $B_2H_6$ {ppm} (vs. $SiH_4$) | 100 | — |
| $CH_4$ {ml/min (normal)} | 50 | 500 |
| Substrate temperature {° C.} | 250 | 250 |
| Pressure in reactive vessel {Pa} | 60 | 60 |
| High frequency power {W} | 250 | 250 |
| Film thickness {μm} | 0.003 to 1.5 | 0.8 |

The negative charging photosensitive member obtained according to the procedure described above was evaluated in the size of spherical protrusions. In the evaluation of the size of spherical protrusions, the surface of the first layer seen through the surface layer and upper blocking layer was observed by an optical microscope to examine the diameter of the largest spherical protrusion. As the result, it was found that, under the production conditions of this Example, the diameter was about 60 μm in every photosensitive member of A-7A to A-7F. The ratio of the layer thickness of the upper blocking layer to the diameter of the largest spherical protrusion was determined.

The negative charging photosensitive members obtained were evaluated in the same manner as in Example A-1, and evaluation was further made on image defects after running.

Image defects after running:

The electrophotographic photosensitive members obtained were each set in the electrophotographic apparatus to conduct a 100,000-sheet continuous paper feed running test in A4-size paper lateral feed. After the 100,000-sheet paper feed running, copies of an A3-size white blank original were taken. The images thus obtained were observed to count the number of black spots coming from spherical protrusions of 0.3 mm or more in diameter.

The results obtained were ranked in comparison with the number of black spots on images before paper feed running.

A: Any image defects are seen not to have become worse even after the running. Very good.

B: Image defects have slightly become worse, but showing an increase by less than 10%. Good.

C: Image defects are seen to have increased by 10% or more to less than 20%, but no problem in practical use.

The results of evaluation are shown in Table A-18. As can be seen from Table A-18, it has been found preferable, in order to obtain the effect of reducing image defects in the present invention, to flatten the projection portions of the spherical protrusions present at the surface of the first layer and also to make the upper blocking layer have a layer thickness of $10^{-4}$ time the diameter of the largest spherical protrusion. Also, the effect of reducing image defects was sufficiently obtained in respect of the photosensitive member A-7F, whose upper blocking layer was 1.5 μm thick, but a lowering of sensitivity was a little seen. Thus, it is found preferable to control the upper limit of the layer thickness to be 1 μm or less.

TABLE A-18

| | | Example A-7 | | | | | |
|---|---|---|---|---|---|---|---|
| Drum number | | A-7A | A-7B | A-7C | A-7D | A-7E | A-7F |
| Thickness of upper blocking layer (μm) | | 0.003 | 0.006 | 0.1 | 0.5 | 1 | 1.5 |
| Ratio of thickness of upper blocking layer to diameter of largest spherical protrusion | | $5 \times 10^{-5}$ | $1 \times 10^{-4}$ | $1.7 \times 10^{-3}$ | $8.3 \times 10^{-3}$ | $1.7 \times 10^{-2}$ | $2.5 \times 10^{-2}$ |
| Evaluation | Number of spherical protrusions | C | C | C | C | C | C |
| | Image defects | B | A | A | A | A | A |
| | Image defects after running | B | A | A | A | A | A |
| | Charge capability | B | A | A | A | A | A |
| | Remaining potential | B | A | A | A | A | A |

As described above, by exposing the first layer to atmospheric air after forming the first layer, image defects otherwise occurring based on spherical protrusions could be considerably reduced. That is, according to the present invention, a method for producing an electrophotographic photosensitive member having reduced image defects, providing high image quality and capable of being used easily, which can be produced inexpensively, stably and in high yields without sacrificing electric characteristics, the electrophotographic photosensitive member, and an electrophotographic apparatus can be provided.

Furthermore, by forming the second layer after polishing and thereby flattening projection portions of spherical protrusions in the second step, spherical protrusions can be prevented from appearing in the image more effectively.

Furthermore, if the photosensitive member is made to contact water after the second step and before the third step, the effect is still further enhanced. Specifically, by washing the photosensitive member with water, adhesion properties is improved when subsequently a surface protection layer is formed, and thus peeling becomes hard to occur.

Furthermore, by carrying out inspections of the photosensitive member as required in the second step, subsequent steps can be omitted for defective photosensitive members, thus making it possible to achieve cost reduction as a whole.

Example B-1

The a-Si photosensitive member forming apparatus of RF plasma CVD system shown in FIG. 5 was used to form an electrophotographic photosensitive member having as a first layer a photoconductive layer constituted by a non-single crystal material formed on a cylindrical Al substrate with the diameter of 108 mm under conditions shown in Table B-1.

Then, the electrophotographic photosensitive member with the first layer formed thereon was temporarily taken out from a film forming apparatus and exposed to atmospheric air. After the electrophotographic photosensitive member was left standing in atmospheric air for 5 minutes, it was returned to the film forming apparatus to form an electrophotographic photosensitive member having formed thereon an upper blocking layer constituted by a non-single crystal material as a second layer.

Then, an electrophotographic photosensitive member having formed on the upper blocking layer a surface layer constituted by a non-single crystal material having carbon atoms as a base material was formed.

The photosensitive member obtained according to the procedure described above is an electrophotographic photosensitive member for use in negative charge, and it was evaluated by the evaluation method described later. The results are shown in Table B-3.

Comparative Example B-1

The a-Si photosensitive member forming apparatus of RF plasma CVD system shown in FIG. 5 was used to form an electrophotographic photosensitive member having as a first layer a photoconductive layer constituted by a non-single crystal material formed on a cylindrical Al substrate with the diameter of 108 mm under conditions shown in Table B-1.

Then, an upper blocking layer constituted by a non-single crystal material was formed as a second layer on the first layer successively without exposing the photosensitive member to atmospheric air.

Then, an electrophotographic photosensitive member having formed on the upper blocking layer a surface layer having carbon atoms as a base material was formed.

The photosensitive member obtained according to the procedure described above is an electrophotographic photosensitive member for use in negative charge, and it was evaluated in the same manner as the evaluation method in Example B-1. The results are shown in Table B-3.

TABLE B-1

| | First layer | Second layer | |
|---|---|---|---|
| Gas type and flow rate | Photo-conductive layer | Upper blocking layer | Surface layer |
| $SiH_4$ {ml/min (normal)} | 400 | 150 | 0 |
| $B_2H_6$ {ppm} (vs. $SiH_4$) | 0 | 3000 | 0 |
| $CH_4$ {ml/min (normal)} | 0 | 150 | 1000 |
| Substrate temperature {° C.} | 240 | 240 | 100 |

TABLE B-1-continued

| Gas type and flow rate | First layer Photo-conductive layer | Second layer Upper blocking layer | Second layer Surface layer |
|---|---|---|---|
| Pressure in reactive vessel {Pa} | 67 | 67 | 67 |
| High frequency power {W} | 500 | 300 | 250 |
| Film thickness {μm} | 25 | 0.3 | 0.3 |

The (normal) represents a volume under normal conditions.

Comparative Example B-2

The a-Si photosensitive member forming apparatus of RF plasma CVD system shown in FIG. 5 was used to form an electrophotographic photosensitive member having a photoconductive layer constituted by a non-single crystal material as a first layer and a surface layer constituted by a non-single crystal material having carbon atoms as a base material formed successively on a cylindrical Al substrate with the diameter of 108 mm, without being exposed to atmospheric air, under conditions shown in Table B-2.

Furthermore, in this Comparative Example, the upper blocking layer constituted by a non-single crystal material was not formed on the second layer.

The photosensitive member obtained according to the procedure described above is an electrophotographic photosensitive member for use in negative charge, and it was evaluated in the same manner as the evaluation method in Example A-1 except that for the number of spherical protrusions, image defects, charge capability and the remaining potential, the values in Comparative Example B-2 were defined as 100%. The results are shown in Table B-4.

TABLE B-2

| Gas type and flow rate | First layer Photo-conductive layer | Second layer Upper blocking layer (not formed) | Second layer Surface layer |
|---|---|---|---|
| $SiH_4$ {ml/min (normal)} | 400 | 0 | 0 |
| $CH_4$ {ml/min (normal)} | 0 | 0 | 1000 |
| Substrate temperature {° C.} | 240 | 0 | 100 |
| Pressure in reactive vessel {Pa} | 67 | 0 | 67 |
| High frequency power {W} | 500 | 0 | 250 |
| Film thickness {μm} | 25 | 0 | 0.3 |

TABLE B-3

| | Number of spherical protrusions | Image defects | Charge capability | Remaining potential |
|---|---|---|---|---|
| Example B-1 | C | B | A | A |
| Comparative Example B-1 | C | C | A | A |
| Comparative Example B-2 | C | C | C | C |

As apparent from Table B-3, the electrophotographic photosensitive member of the present invention is equivalent in the number of spherical protrusions to those of Comparative Examples B-1 and B-2, but it is considerably improved in the number of black spots being image defects. Furthermore, it is found that the electrophotographic photosensitive member is improved in charge capability and remaining potential, and even if the photosensitive member is temporarily exposed to atmospheric air after the first layer is formed and before the second layer is formed, its characteristics are not adversely affected.

Example B-2

The a-Si photosensitive member forming apparatus of VHF plasma CVD system shown in FIG. 6 was used to form an electrophotographic photosensitive member having as a first layer a lower blocking layer constituted by a non-single crystal material and a photoconductive layer constituted by a non-single crystal material formed on a cylindrical Al substrate with the diameter of 108 mm under conditions shown in Table B-4.

Then, in this state, atmospheric air was introduced into a film forming apparatus through a leak valve to expose the electrophotographic photosensitive member with the first layer formed thereon to atmospheric air. After the electrophotographic photosensitive member was left standing in this state for 5 minutes, the film forming apparatus was decompressed again to form an electrophotographic photosensitive member having formed on the first layer an upper blocking layer constituted by a non-single crystal material as a second layer under conditions shown in Table B-4.

Then, a surface layer constituted by a non-single crystal material having carbon atoms as a base material was formed on the upper blocking layer.

The photosensitive member fabricated according to the procedure described above is an electrophotographic photosensitive member for use in positive charge, and it was evaluated in the same manner as the evaluation method in Example B-1. The results are shown in Table B-5.

Comparative Example B-3

The a-Si photosensitive member forming apparatus of VHF plasma CVD system shown in FIG. 6 was used to form an electrophotographic photosensitive member having as a first layer a lower blocking layer constituted by a non-single crystal material and a photoconductive layer constituted by a non-single crystal material formed on a cylindrical Al substrate with the diameter of 108 mm under conditions shown in Table B-4. Then, in this state, $O_2$ gas was introduced into a film forming apparatus to an atmospheric pressure to expose the electrophotographic photosensitive member to an oxygen atmosphere. After the electrophotographic photosensitive member was left standing in this state for 5 minutes, the film forming apparatus was decompressed again to form an electrophotographic photosensitive member having formed on the first layer an upper blocking layer constituted by a non-single crystal material as a second layer under conditions shown in Table B-4.

Then, an electrophotographic photosensitive member having formed on the upper blocking layer a surface layer constituted by a non-single crystal material having carbon atoms as a base material was formed.

The photosensitive member fabricated according to the procedure described above is an electrophotographic photosensitive member for use in positive charge, and it was evaluated in the same manner as the evaluation method in Example B-1. The results are shown in Table B-5.

TABLE B-4

| Gas type and flow rate | First layer | | Second layer | |
|---|---|---|---|---|
| | Lower blocking layer | Photo-conductive layer | Upper blocking layer | Surface layer |
| $SiH_4$ {ml/min (normal)} | 150 | 100 | 200 | 0 |
| $H_2$ {ml/min (normal)} | 150 | 100 | 0 | 0 |
| $B_2H_6$ {ppm} (vs. $SiH_4$) | 500 | 0.3 | 0 | 0 |
| $PH_3$ {ppm} {vs. $SiH_4$) | 0 | 0 | 1000 | 0 |
| NO {ml/min (normal)} | 10 | 0 | 0 | 0 |
| $CH_4$ {ml/min (normal)} | 0 | 0 | 200 | 1200 |
| Substrate temperature {° C.} | 200 | 200 | 240 | 100 |
| Pressure in reactive vessel {Pa} | 0.8 | 0.8 | 0.8 | 0.8 |
| High frequency power {W} | 300 | 300 | 270 | 600 |
| Film thickness {μm} | 3 | 30 | 0.3 | 0.5 |

TABLE B-5

| | Number of spherical protrusions | Image defects | Charge capability | Remaining potential |
|---|---|---|---|---|
| Example B-2 | C | B | A | A |
| Comparative Example B-3 | C | C | A | A |

As apparent from Table B-5, even with the film formation method using the VHF system, the effect of the present invention can be achieved as in the case of the film formation method using the RF system. Furthermore, it is found that the effect of the present invention can be achieved merely by exposing the photosensitive member to atmospheric air in the film forming apparatus. However, from the fact that no effect was found even though the photosensitive member was exposed to an oxygen atmosphere, it is estimated that the effect is not associated simply with oxidization of the surface but with some interaction with atmospheric air.

Example B-3

The a-Si photosensitive member forming apparatus of VHF plasma CVD system shown in FIG. 6 was used to form an electrophotographic photosensitive member having as a first layer a lower blocking layer constituted by a non-single crystal material and a photoconductive layer constituted by a non-single crystal material formed on a cylindrical Al substrate with the diameter of 108 mm under conditions shown in Table B-6.

Then, the electrophotographic photosensitive member with the first layer formed thereon was temporarily taken out from a film forming apparatus and exposed to atmospheric air, and thereafter the electrophotographic photosensitive member with the first layer formed thereon was returned to the film forming apparatus to form an electrophotographic photosensitive member having an a-Si based intermediate layer formed as a second layer on the first layer and an upper blocking layer constituted by a non-single crystal material formed on the intermediate layer.

Then, a surface layer constituted by a non-single crystal material having carbon atoms as a base material was formed on the upper blocking layer.

The photosensitive member obtained according to the procedure described above is an electrophotographic photosensitive member for use in negative charge, and it was evaluated in the same manner as the evaluation method in Example B-1. The results are shown in Table B-7.

Example B-4

The a-Si photosensitive member forming apparatus of VHF plasma CVD system shown in FIG. 6 was used to form an electrophotographic photosensitive member having as a first layer a lower blocking layer constituted by a non-single crystal material and a photoconductive layer constituted by a non-single crystal material formed on a cylindrical Al substrate with the diameter of 108 mm under conditions shown in Table B-6.

Then, the electrophotographic photosensitive member with the first layer formed thereon was temporarily taken out from a film forming apparatus and exposed to atmospheric air. In this Example, at this time, the polishing apparatus shown in FIG. 7 was used to polish the surface to flatten projection portions of spherical protrusions. Then, the electrophotographic photosensitive member was washed by the water washing apparatus shown in FIG. 8. Thereafter, the electrophotographic photosensitive member with the first layer formed thereon was returned to the film forming apparatus to form an electrophotographic photosensitive member having an a-Si based intermediate layer formed as a second layer on the first layer and an upper blocking layer constituted by a non-single crystal material formed on the intermediate layer.

Then, a surface layer constituted by a non-single crystal material having carbon atoms as a base material was formed on the upper blocking layer.

The photosensitive member obtained according to the procedure described above is an electrophotographic photosensitive member for use in negative charge, and it was evaluated in the same manner as the evaluation method in Example B-1. The results are shown in Table B-7 along with the results of Example B-3.

TABLE B-6

| Gas type and flow rate | First layer | | Second layer | | |
|---|---|---|---|---|---|
| | Lower blocking layer | Photo-conductive layer | Inter-mediate layer | Upper blocking layer | Surface layer |
| $SiH_4$ {ml/min (normal)} | 200 | 200 | 50 | 150 | 0 |

TABLE B-6-continued

| Gas type and flow rate | First layer | | Second layer | | |
|---|---|---|---|---|---|
| | Lower blocking layer | Photo-conductive layer | Inter-mediate layer | Upper blocking layer | Surface layer |
| $B_2H_6$ {ppm}(vs. $SiH_4$) | 0 | 0 | 0 | 3000 | 0 |
| $PH_3$ {ppm}(vs. $SiH_4$) | 1500 | 1.0 | 0 | 0 | 0 |
| NO {ml/min (normal)} | 10 | 0 | 0 | 0 | 0 |
| $CH_4$ {ml/min (normal)} | 0 | 0 | 100 | 150 | 1200 |
| Substrate temperature {° C.} | 200 | 200 | 220 | 240 | 80 |
| Pressure in reaction vessel {Pa} | 0.8 | 0.8 | 0.8 | 0.8 | 0.8 |
| High frequency power {W} | 1000 | 2000 | 1000 | 800 | 1800 |
| Film thickness {μm} | 3 | 30 | 0.5 | 0.5 | 0.5 |

TABLE B-7

| | Number of spherical protrusions | Image defects | Charge capability | Remaining potential |
|---|---|---|---|---|
| Example B-3 | C | B | A | A |
| Example B-4 | C | A | A | A |

As apparent from Table B-7, it can be understood that the effect of the present invention can be achieved even if an intermediate layer is provided in the second layer. Furthermore, it is found that the image defect reduction effect is enhanced if a second layer is formed after projection portions of spherical protrusions are flattened.

Example B-5

The a-Si photosensitive member forming apparatus of RF plasma CVD system shown in FIG. 5 was used to form an electrophotographic photosensitive member having as a first layer a lower blocking layer constituted by a non-single crystal material and a photoconductive layer constituted by a non-single crystal material formed on a cylindrical Al substrate with the diameter of 108 mm under conditions shown in Table B-8.

Then, the electrophotographic photosensitive member with the first layer formed thereon was temporarily taken out from a film forming apparatus and exposed to atmospheric air. After the electrophotographic photosensitive member was left standing in atmospheric air for 10 minutes, it was washed by the water washing apparatus shown in FIG. 8. Thereafter, the electrophotographic photosensitive member with the first layer formed thereon was returned to the film forming apparatus to form an electrophotographic photosensitive member having an a-Si based intermediate layer formed as a second layer on the first layer and an upper blocking layer constituted by a non-single crystal material formed on the intermediate layer.

Then, an electrophotographic photosensitive member having formed on the upper blocking layer a surface layer constituted by a non-single crystal material having carbon atoms as a base material was formed.

Furthermore, in this Example, photosensitive members B-5A to B-5F having different thicknesses of the upper blocking layer due to adjustment of time spent for forming the layer were fabricated.

The negative charging electrophotographic photosensitive member obtained according to the procedure described above was evaluated in the same manner as the evaluation method in Example B-1, and evaluations were made for the size of spherical protrusions. The entire surface of the obtained electrophotographic photosensitive member was observed by an optical microscope to measure a diameter of the largest spherical protrusion. As a result, it is found that the diameter is about 100 μm for any electrophotographic photosensitive member under production conditions of this Example. The ratio of thickness of the upper blocking layer to the diameter of the largest spherical protrusion measured in this way was determined.

The results are shown in Table B-9.

TABLE B-8

| Gas type and flow rate | First layer | | Second layer | | |
|---|---|---|---|---|---|
| | Lower blocking layer | Photo-conductive layer | Inter-mediate layer | Upper blocking layer | Surface layer |
| $SiH_4$ {ml/min (normal)} | 400 | 200 | 60 | 100 | 0 |
| $B_2H_6$ {ppm}(vs. $SiH_4$) | 0 | 0 | 0 | 2000 | 0 |

TABLE B-8-continued

| Gas type and flow rate | First layer | | Second layer | | |
|---|---|---|---|---|---|
| | Lower blocking layer | Photo-conductive layer | Inter-mediate layer | Upper blocking layer | Surface layer |
| $PH_3$ {ppm}(vs. $SiH_4$) | 3000 | 1.0 | 0 | 0 | 0 |
| NO {ml/min (normal)} | 10 | 0 | 0 | 0 | 0 |
| $CH_4$ {ml/min (normal)} | 0 | 0 | 120 | 100 | 800 |
| Substrate temperature {° C.} | 250 | 260 | 200 | 230 | 90 |
| Pressure in reaction vessel {Pa} | 76 | 76 | 76 | 76 | 76 |
| High frequency power {W} | 150 | 320 | 600 | 260 | 800 |
| Film thickness {μm} | 5 | 30 | 0.3 | 0.001 to 2 | 0.3 |

TABLE B-9

| Electrophotographic photosensitive member number | | Example B-5 | | | | | |
|---|---|---|---|---|---|---|---|
| | | B-5A | B-5B | B-5C | B-5D | B-5E | B-5F |
| Thickness of upper blocking layer(μm) | | 0.001 | 0.005 | 0.01 | 0.1 | 1 | 2 |
| Ratio of thickness of upper blocking layer to diameter of largest spherical protrusion | | $1 \times 10^{-5}$ | $5 \times 10^{-5}$ | $1 \times 10^{-4}$ | $1 \times 10^{-3}$ | $1 \times 10^{-2}$ | $2 \times 10^{-2}$ |
| Evaluation | Number of spherical protrusions | C | C | C | C | C | C |
| | Image defects | C | C | B | B | B | B |
| | Charge capability | B | B | A | A | A | A |
| | Remaining potential | B | B | A | A | A | A |

As apparent from Table B-9, the thickness of the upper blocking layer is preferably $1\times10^{-4}$ times or more as large as the diameter of the largest spherical protrusion for achieving the effect of reducing black spots being image defects of the present invention. Furthermore, for the photosensitive member B-5F, the effect of reducing black spots could be sufficiently achieved, but the thickness of the upper blocking layer was so large that the sensitivity was reduced. Thus, it can be understood that the upper limit of the thickness is desirably 1 μm or less. Furthermore, adhesion properties were improved by washing the photosensitive member by a water washing apparatus before forming thereon the second layer.

Example B-6

The a-Si photosensitive member forming apparatus of RF plasma CVD system shown in FIG. 5 was used to form an electrophotographic photosensitive member having as a first layer a lower blocking layer constituted by a non-single crystal material and a photoconductive layer constituted by a non-single crystal material formed on a cylindrical Al substrate with the diameter of 108 mm under conditions shown in Table B-10.

Then, a leak valve was opened to introduce atmospheric air into a film forming apparatus while the electrophotographic photosensitive member with the first layer formed thereon was left in the film forming apparatus. In this way, the electrophotographic photosensitive member was exposed to atmospheric air and left standing for about 10 minutes, and thereafter the electrophotographic photosensitive member was taken out from the film forming apparatus, and was washed by the water washing apparatus shown in FIG. 8. Thereafter, the electrophotographic photosensitive member was returned to the film forming apparatus where the first layer had been formed, followed by decompressing the film forming apparatus, and subsequently forming an electrophotographic photosensitive member having an a-Si based intermediate layer formed as a second layer on the first layer and an upper blocking layer constituted by a non-single crystal material formed on the intermediate layer.

Then, a surface layer constituted by a non-single crystal material having carbon atoms as a base material was formed on the upper blocking layer.

Furthermore, in this Example, photosensitive members B-6G to B-6L having different contents of B (boron) being an atom of Group 13 contained in the upper blocking layer due to variation of the concentration of $B_2H_6$ being a raw material gas were formed.

The negative charging electrophotographic photosensitive member obtained according to the procedure described above was evaluated in the same manner as the evaluation method in Example B-1.

After evaluations were made, each photosensitive member was cut to expose a section to carry out a SIMS analysis (secondary ion mass spectrometry), thereby measuring the content of B (boron) in the upper blocking layer. The results are shown in Table B-11.

TABLE B-10

| Gas type and flow rate | First layer | | Second layer | | |
|---|---|---|---|---|---|
| | Lower blocking layer | Photo-conductive layer | Inter-mediate layer | Upper blocking layer | Surface layer |
| $SiH_4$ {ml/min (normal)} | 100 | 300 | 70 | 100 | 0 |
| $H_2$ {ml/min (normal)} | 0 | 0 | 0 | 0 | 0 |
| $B_2H_6$ {ppm}(vs. $SiH_4$) | 0 | 0 | 0 | Change | 0 |
| $PH_3$ {ppm}(vs. $SiH_4$) | 750 | 1.5 | 0 | 0 | 0 |
| NO {ml/min (normal)} | 5.0 | 0 | 0 | 0 | 0 |
| $CH_4$ {ml/min (normal)} | 0 | 0 | 140 | 500 | 1100 |
| Substrate temperature {° C.} | 260 | 250 | 180 | 220 | 110 |
| Pressure in reaction vessel {Pa} | 76 | 76 | 76 | 76 | 76 |
| High frequency power {W} | 150 | 500 | 550 | 230 | 1400 |
| Film thickness {μm} | 3 | 25 | 0.3 | 0.3 | 0.5 |

TABLE B-11

| Electrophotographic photosensitive member number | | Example B-6 | | | | | |
|---|---|---|---|---|---|---|---|
| | | B-6G | B-6H | B-6I | B-6J | B-6K | B-6L |
| Content of B (boron) | | 80 | 100 | 1000 | 10000 | 30000 | 35000 |
| Evaluation | Number of spherical protrusions | C | C | C | C | C | C |
| | Image defects | C | B | B | B | B | C |
| | Charge capability | C | A | A | A | A | C |
| | Remaining potential | C | A | A | A | A | C |

As apparent from Table B-11, the content of impurity in the upper blocking layer is preferably 100 ppm to 30,000 ppm.

Example C-1

Using the a-Si photosensitive member forming apparatus of RF plasma CVD system shown in FIG. 5, a photoconductive layer constituted by a non-single crystal material and a silicon carbide layer constituted by a non-single crystal material containing carbon and silicon were formed as a first layer on a cylindrical Al substrate with the outer diameter of 108 mm under conditions shown in Table C-1.

TABLE C-1

| Gas type and flow rate | First layer | | Second layer | |
|---|---|---|---|---|
| | Photo-conductive layer | Silicon carbide layer | Upper blocking layer | Surface layer |
| $SiH_4$ [ml/min (normal)] | 400 | 60 | 150 | — |
| $B_2H_6$ [ppm] (vs. $SiH_4$) | — | — | 3000 | — |

TABLE C-1-continued

| Gas type and flow rate | First layer | | Second layer | |
|---|---|---|---|---|
| | Photo-conductive layer | Silicon carbide layer | Upper blocking layer | Surface layer |
| $CH_4$ [ml/min (normal)] | — | 120 | 150 | 1000 |
| Substrate temperature [° C.] | 240 | 200 | 240 | 100 |
| Pressure in reactive vessel | 67 | 76 | 67 | 67 |

TABLE C-1-continued

| Gas type and flow rate | First layer | | Second layer | |
|---|---|---|---|---|
| | Photo-conductive layer | Silicon carbide layer | Upper blocking layer | Surface layer |
| [Pa] | | | | |
| High frequency power [W] | 500 | 600 | 300 | 250 |
| Film thickness [μm] | 25 | 0.5 | 0.3 | 0.3 |

Then, the substrate with the first layer formed thereon was temporarily taken out from a film forming apparatus and exposed to atmospheric air.

The substrate with the first layer formed thereon was left standing in atmospheric air for 5 minutes, and was thereafter returned to the film forming apparatus, where an upper blocking layer constituted by a non-single crystal material was formed as a second layer.

Then, a surface layer constituted by a non-single crystal material having carbon atoms as a base material was formed on the upper blocking layer.

The photosensitive member obtained according to the procedure described above is an electrophotographic photosensitive member for use in negative charge, and it was evaluated in the same manner as Example A-1 except that for spherical protrusions, image defects (black spot), the charge level and the remaining potential, evaluations were made using the evaluations in Comparative Example C-2 as a reference. For the cross batch and heat shock, evaluations were made by the evaluation methods described later. The results are shown in Table C-3.

Comparative Example C-1

Using the a-Si photosensitive member forming apparatus of RF plasma CVD system shown in FIG. 5, a photoconductive layer constituted by a non-single crystal material and a silicon carbide layer constituted by a non-single crystal material containing carbon and silicon were formed as a first layer on a cylindrical Al substrate with the outer diameter of 108 mm under conditions shown in Table C-1.

Then, an upper blocking layer constituted by a non-single crystal material was formed on the first layer successively without being exposed to atmospheric air.

Then, an electrophotographic photosensitive member having formed on the upper blocking layer a surface layer constituted by a non-single crystal material having carbon atoms as a base material was formed.

The photosensitive member obtained according to the procedure described above is an electrophotographic photosensitive member for use in negative charge, and it was evaluated in the same manner as the evaluation method in Example C-1. The results are shown in Table C-3.

Comparative Example C-2

Using the a-Si photosensitive member forming apparatus of RF plasma CVD system shown in FIG. 5, a photoconductive layer constituted by a non-single crystal material and a silicon carbide layer constituted by a non-single crystal material containing carbon and silicon, as a first layer, and a surface layer constituted by a non-single crystal material having carbon atoms as a base material, as second layer, were formed on a cylindrical Al substrate with the outer diameter of 108 mm, without being exposed to atmospheric air, under conditions shown in Table C-2.

TABLE C-2

| Gas type and flow rate | First layer | | Second layer | |
|---|---|---|---|---|
| | Photo-conductive layer | Silicon carbide layer | Upper blocking layer (not formed) | Surface layer |
| $SiH_4$ [mr/min (normal)] | 400 | 60 | — | — |
| $CH_4$ [ml/min (normal)] | — | 120 | — | 1000 |
| Substrate temperature [° C.] | 240 | 200 | — | 100 |
| Pressure in reactive vessel [Pa] | 67 | 76 | — | 67 |
| High frequency power [W] | 500 | 600 | — | 250 |
| Film thickness [μm] | 25 | 0.5 | — | 0.3 |

Furthermore, in this Comparative Example, the upper blocking layer was not formed on the second layer.

The photosensitive member obtained according to the procedure described above is an electrophotographic photosensitive member for use in negative charge, and it was evaluated in the same manner as Example C-1. The results are shown in Table C-3.

Methods for making evaluations on the crosshatch and heat shock will be described below.

Crosshatch

Line scratches were made in a crosshatch form at intervals of 1 cm on the surface of the electrophotographic photosensitive member with the first and second layers formed thereon using a sharp-pointed needle. After this electrophotographic photosensitive member was dipped in water for one weak, it was taken out from water and its surface was observed to visually check whether or not peeling occurred in areas having scratches, and evaluations were made in accordance with the following criteria.

A: No peeling, excellent.

B: Peeling occurs only partially areas having line scratches.

C: A small scale of peeling occurs over a wide area.

Heat Shock

The electrophotographic photosensitive member with the first and second layers formed thereon were left standing for 48 hours in a container adjusted to be kept at a temperature of −20° C., and was then immediately left standing for 2 hours in a container adjusted to be kept at a temperature of 50° C. and a humidity of 95%. After this cycle was repeated ten times, the surface of the electrophotographic photosensitive member was visually observed, and evaluations were made in accordance with the following criteria.

A: No peeling, excellent.

B: Peeling occurs in only a portion in an end of the electrophotographic photosensitive member, but there no problem arises because this portion is not included in an image area.

C: A small scale of peeling occurs over a wide area.

D: Peeling occurs over the entire surface.

TABLE C-3

| | Spherical protrusions | Image defects (black spot) | Charge capability | Remaining potential | Cross hatch | Heat shock |
|---|---|---|---|---|---|---|
| Example C-1 | C | B | A | A | A | A |
| Comparative Example C-1 | C | C | A | A | A | A |
| Comparative Example C-2 | C | C | C | C | A | A |

As apparent from Table C-3, the electrophotographic photosensitive member of the present invention is equivalent in the number of spherical protrusions to those of Comparative Examples C-1 and C-2, but it is considerably improved in the number of black spots being image defects. Furthermore, it is found that the electrophotographic photosensitive member is improved in charge capability and remaining potential, and even if the photosensitive member is temporarily exposed to atmospheric air after the first layer is formed and before the second layer is formed, its characteristics are not adversely affected. Furthermore, it is found that characteristics are not influenced even if a silicon carbide layer is provided on the first layer.

Example C-2

The a-Si photosensitive member forming apparatus of VHF plasma CVD system shown in FIG. 6 was used to form an electrophotographic photosensitive member having as a first layer a lower blocking layer constituted by a non-single crystal material, a photoconductive layer constituted by a non-single crystal material, and a silicon carbide layer constituted by a non-single crystal material containing carbon and silica, formed on a cylindrical Al substrate with the outer diameter of 108 mm under conditions shown in Table C-4.

Then, in this state, atmospheric air was introduced into a film forming apparatus through a leak valve to expose the electrophotographic photosensitive member with the first layer formed thereon to atmospheric air. After the electrophotographic photosensitive member was left standing in this state for 5 minutes, the film forming apparatus was decompressed again to form on the first layer an upper blocking layer constituted by a non-single crystal material as a second layer.

Then, a surface layer constituted by a non-single crystal material having carbon atoms as a base material was formed on the upper blocking layer.

The photosensitive member fabricated according to the procedure described above is an electrophotographic photosensitive member for use in positive charge, and it was evaluated in the same manner as the evaluation method in Example 1. The results are shown in Table C-5.

Comparative Example C-3

The a-Si photosensitive member forming apparatus of VHF plasma CVD system shown in FIG. 6 was used to form an electrophotographic photosensitive member having as a first layer a lower blocking layer constituted by a non-single crystal material, a photoconductive layer constituted by a non-single crystal material, and a silicon carbide layer constituted by a non-single crystal material containing carbon and silica, formed on a cylindrical Al substrate with the outer diameter of 108 mm under conditions shown in Table C-4.

Then, in this state, $O_2$ gas was introduced into a film forming apparatus to an atmospheric pressure to expose the electrophotographic photosensitive member to an oxygen atmosphere.

After the electrophotographic photosensitive member was left standing in this state for 5 minutes, the film forming apparatus was decompressed again to form on the first layer

TABLE C-4

| | First layer | | | Second layer | |
|---|---|---|---|---|---|
| Gas type and flow rate | Lower blocking layer | Photo-conductive layer | Silicon carbide layer | Upper blocking layer | Surface layer |
| $SiH_4$ {ml/min (normal)} | 150 | 100 | 50 | 200 | — |
| $H_2$ {ml/min (normal)} | 150 | 100 | 100 | — | — |
| $B_2H_6$ {ppm}(vs. $SiH_4$) | 500 | 0.3 | 0.3 | — | — |
| $PH_3$ {ppm}(vs. $SiH_4$) | — | — | — | 1000 | — |
| NO {ml/min (normal)} | 10 | — | — | — | — |
| $CH_4$ {ml/min (normal)} | — | — | 100 | 200 | 1200 |
| Substrate temperature {° C.} | 200 | 200 | 210 | 240 | 100 |
| Pressure in reaction vessel {Pa} | 0.8 | 0.8 | 0.8 | 0.8 | 0.8 |
| High frequency power {W} | 300 | 300 | 500 | 270 | 600 |
| Film thickness {μm} | 3 | 30 | 0.5 | 0.3 | 0.5 |

an upper blocking layer constituted by at least a non-single crystal material as a second layer.

Then, a surface layer constituted by a non-single crystal material having carbon atoms as a base material was formed on the upper blocking layer.

The photosensitive member fabricated according to the procedure described above is an electrophotographic photosensitive member for use in positive charge, and it was evaluated in the same manner as the evaluation method in Example C-1. The results are shown in Table C-5.

TABLE C-5

| | Spherical protrusions | Image defects (black spot) | Charge capa-bility | Remaining potential | Cross hatch | Heat shock |
|---|---|---|---|---|---|---|
| Example C-2 | C | B | A | A | A | A |
| Comparative Example C-3 | C | C | A | A | A | A |

As apparent from Table C-5, the effect of the present invention can be achieved merely by exposing the photosensitive member to atmospheric air in the film forming apparatus. Furthermore, from the fact that no effect was found even though the photosensitive member was exposed to an oxygen atmosphere, it is estimated that the effect is not associated simply with oxidization of the surface but with some interaction with atmospheric air.

Furthermore, even with the film formation method using the VHF system, the effect of the present invention can be achieved as in the case of the film formation method using the RF system. Furthermore, it is found that the characteristics are not influenced even if a lower blocking is provided on the first layer.

Example C-3

The a-Si photosensitive member forming apparatus of VHF plasma CVD system shown in FIG. 6 was used to form an electrophotographic photosensitive member having as a first layer a lower blocking layer constituted by a non-single crystal material, a photoconductive layer constituted by a non-single crystal material, and a silicon carbide layer constituted by a non-single crystal material containing carbon and silica, formed on a cylindrical Al substrate with the outer diameter of 108 mm under conditions shown in Table C-6.

Then, the electrophotographic photosensitive member with the first layer formed thereon was temporarily taken out from a film forming apparatus and exposed to atmospheric air, and thereafter the electrophotographic photosensitive member with the first layer formed thereon was returned to the film forming apparatus to form an a-Si based intermediate layer as a second layer on the first layer and form an upper blocking layer constituted by a non-single crystal material on the intermediate layer.

Then, a surface layer constituted by a non-single crystal material having carbon atoms as a base material was formed on the upper blocking layer.

The photosensitive member obtained according to the procedure described above is an electrophotographic photosensitive member for use in negative charge, and evaluations were made by the evaluation methods described later for film adhesion characteristics and polishing scares, and for other items, evaluation were made in the same manner as the evaluation method in Example C-1. The results are shown in Table C-8.

Example C-4

The a-Si photosensitive member forming apparatus of VHF plasma CVD system shown in FIG. 6 was used to form an electrophotographic photosensitive member having as a first layer a lower blocking layer constituted by a non-single crystal material, a photoconductive layer constituted by a non-single crystal material, and a silicon carbide layer constituted by a non-single crystal material containing carbon and silica, formed on a cylindrical Al substrate with the outer diameter of 108 mm under conditions shown in Table C-6.

TABLE C-6

| | First layer | | | Second layer | | |
|---|---|---|---|---|---|---|
| Gas type and flow rate | Lower blocking layer | Photo-conductive layer | Silicon carbide layer | Intermediate layer | Upper blocking layer | Surface layer |
| $SiH_4$ [ml/min (normal)] | 200 | 200 | 70 | 50 | 150 | — |
| $H_2$ [ml/min (normal)] | — | — | — | — | — | — |
| $B_2H_6$ [ppm] (vs. $SiH_4$) | — | — | — | — | 3000 | — |
| $PH_3$ [ppm] (vs. $SiH_4$) | 1500 | 1.0 | 1.0 | — | — | — |
| NO [ml/min (normal)] | 10 | — | — | — | — | — |
| $CH_4$ [ml/min (normal)] | — | — | 140 | 100 | 150 | 1200 |
| Substrate temperature [° C.] | 200 | 200 | 200 | 220 | 240 | 80 |
| Pressure in reactive vessel [Pa] | 0.8 | 0.8 | 0.8 | 0.8 | 0.8 | 0.8 |
| High frequency power [W] | 1000 | 2000 | 2000 | 1000 | 800 | 1800 |
| Film thickness [μm] | 3 | 30 | 30 | 0.5 | 0.5 | 0.5 |

Then, the substrate with the first layer formed thereon was temporarily taken out from a film forming apparatus and exposed to atmospheric air.

In this Example, at this time, the polishing apparatus shown in FIG. 7 was used to polish the surface to flatten projection portions of spherical protrusions.

Then, the water washing apparatus shown in FIG. 8 was used to wash the surface.

Thereafter, the electrophotographic photosensitive member with the first layer formed thereon was returned to the film forming apparatus to form an a-Si based intermediate layer as a second layer on the first layer and form an upper blocking layer constituted by a non-single crystal material on the intermediate layer.

Then, a surface layer constituted by a non-single crystal material having carbon atoms as a base material was formed.

The photosensitive member obtained according to the procedure described above is an electrophotographic photosensitive member for use in negative charge, and it was evaluated in the same manner as the evaluation method in Example C-1. The results are shown in Table C-8.

Example C-5

The a-Si photosensitive member forming apparatus of VHF plasma CVD system shown in FIG. 6 was used to form an electrophotographic photosensitive member having as a first layer a photoconductive layer constituted by a non-single crystal material formed on a cylindrical Al substrate with the outer diameter of 108 mm under conditions shown in Table C-7.

TABLE C-7

| | First layer | | Second layer | | |
|---|---|---|---|---|---|
| Gas type and flow rate | Lower blocking layer | Photo-conductive layer | Intermediate layer | Upper blocking layer | Surface layer |
| $SiH_4$ [ml/min (normal)] | 200 | 200 | 50 | 150 | — |
| $H_2$ [ml/min (normal)] | — | — | — | — | — |
| $B_2H_6$ [ppm] (vs. $SiH_4$) | — | — | — | 3000 | — |
| $PH_3$ [ppm] (vs. $SiH_4$) | 1500 | 1.0 | — | — | — |
| NO [ml/min (normal)] | 10 | — | — | — | — |
| $CH_4$ [ml/min (normal)] | — | — | 100 | 150 | 1200 |
| Substrate temperature [° C.] | 200 | 200 | 220 | 240 | 80 |
| Pressure in reactive vessel [Pa] | 0.8 | 0.8 | 0.8 | 0.8 | 0.8 |
| High frequency power [W] | 1000 | 2000 | 1000 | 800 | 1800 |
| Film thickness [μm] | 3 | 30 | 0.5 | 0.5 | 0.5 |

Then, the substrate with the first layer formed thereon was temporarily taken out from a film forming apparatus and exposed to atmospheric air.

In this Example, at this time, the polishing apparatus shown in FIG. 7 was used to polish the surface to flatten projection portions of spherical protrusions. The sizes of irregularities on the surface before being polished were 10 μm or greater, but they were reduced to 1 μm by this flattening process.

Irregularities of protrusions were evaluated with a difference between Z1 and Z2, in which the position when the top of the protrusion was brought into focus was defined as Z1, and the position when a nearby normal area was brought into focus was defined as Z2, using a microscope with a Z direction (far-and-near direction of subject and objective lens) position sensing function (STM-5 manufactured by Olympus Co., Ltd.). Then, the water washing apparatus shown in FIG. 8 was used to wash the surface.

Thereafter, the electrophotographic photosensitive member with the first layer formed thereon was returned to the film forming apparatus to form an a-Si based intermediate layer as a second layer on the first layer and form an upper blocking layer constituted by a non-single crystal material on the intermediate layer.

Then, a surface layer constituted by a non-single crystal material having carbon atoms as a base material was formed.

Furthermore, in this Example, a silicon carbide layer constituted by at least a non-single crystal material containing carbon and silicon was not formed.

The photosensitive member obtained according to the procedure described above is an electrophotographic photosensitive member for use in negative charge, and it was evaluated in the same manner as the evaluation method in Example C-1 except for the polishing scaremaininghe results are shown in Table C-8.

Polishing Scares

The electrophotographic photosensitive member with the first layer formed thereon was placed in the polishing apparatus shown in FIG. 7 to polish the photosensitive material. The surface of the electrophotographic photosensitive material was visually checked after it was polished. The obtained results were rated in relative evaluation with the values in Example C-5 defined as 100%.

A: Polishing scares are reduced by 20% or greater.

B: Polishing scares are reduced by 10% or greater.

C: Polishing scares are not reduced compared with Example C-5.

TABLE C-8

| | Spherical pro-trusions | Black spot | Charge capa-bility | Re-main-ing poten-tial | Cross hatch | Heat shock | Polish-ing scares |
|---|---|---|---|---|---|---|---|
| Example C-3 | C | B | A | A | A | A | A |
| Example C-4 | C | A | A | A | A | A | A |

TABLE C-8-continued

| | Spherical protrusions | Black spot | Charge capability | Remaining potential | Cross hatch | Heat shock | Polishing scares |
|---|---|---|---|---|---|---|---|
| Example C-5 | C | C | A | A | A | B | C |

As apparent from Table C-8, by forming the second layer after washing the first layer by a water washing apparatus by forming a silicon carbide layer on the first layer, not only the film adhesion properties are improved, but also the image defect reduction effect is enhanced. Furthermore, it is found that by forming a silicon carbide layer on the first layer, polishing scares occurring when projection portions of spherical protrusions are polished and thereby flattened can be inhibited. Furthermore, it is found that the characteristics are not influenced even if an intermediate layer is provided on the second layer.

Example C-6

The a-Si photosensitive member forming apparatus of RF plasma CVD system shown in FIG. 5 was used to form an electrophotographic photosensitive member having as a first layer a lower blocking layer constituted by a non-single crystal material, a photoconductive layer constituted by a non-single crystal material, and a silicon carbide layer constituted by a non-single crystal material containing carbon and silica, formed on an Al substrate with the outer diameter of 108 mm under conditions shown in Table C-9.

Then, the substrate with the first layer formed thereon was temporarily taken out from a film forming apparatus and exposed to atmospheric air. After the substrate was left standing in atmospheric air for 10 minutes, it is washed by the water washing apparatus shown in FIG. 8.

Thereafter, the substrate with the first layer formed thereon was returned to the film forming apparatus to form an a-Si based intermediate layer as a second layer on the first layer and form an upper blocking layer constituted by a non-single crystal material on the intermediate layer.

Then, a surface layer constituted by a non-single crystal material having carbon atoms as a base material was formed on the upper blocking layer.

Furthermore, in this Example, photosensitive members C-6A to C-6F having different thicknesses the upper blocking layer were fabricated.

The negative charging electrophotographic photosensitive member obtained according to the procedure described above was evaluated in the same manner as the evaluation method in Example C-1, and the sizes of spherical protrusions were evaluated. The entire surface of the obtained electrophotographic photosensitive member was observed by an optical microscope to measure an appropriate diameter of the largest spherical protrusion.

As a result, it is found that the diameter is about 100 μm for any electrophotographic photosensitive member under production conditions of this Example. The ratio of thickness of the upper blocking layer to the diameter of the largest spherical protrusion measured in this way was determined.

TABLE C-9

| | First layer | | | Second layer | | |
|---|---|---|---|---|---|---|
| Gas type and flow rate | Lower blocking layer | Photoconductive layer | Silicon carbide layer | Intermediate layer | Upper blocking layer | Surface layer |
| $SiH_4$ [ml/mln (normal)] | 400 | 200 | 55 | 60 | 100 | — |
| $H_2$ [ml/min (normal)] | — | — | — | — | — | — |
| $B_2H_6$ [ppm] (vs. $SiH_4$) | — | — | — | — | 2000 | — |
| $PH_3$ [ppm] (vs. $SiH_4$) | 3000 | 1.0 | — | — | — | — |
| NO [ml/min (normal)] | 10 | — | — | — | — | — |
| $CH_4$ [ml/min (normal)] | — | — | 110 | 120 | 100 | 800 |
| Substrate temperature [° C.] | 250 | 260 | 210 | 200 | 230 | 90 |
| Pressure in reactive vessel [Pa] | 76 | 76 | 76 | 76 | 76 | 76 |
| High frequency power [W] | 150 | 320 | 480 | 500 | 260 | 800 |
| Film thickness [μm] | 5 | 30 | 0.3 | 0.5 | Change | 0.3 |

The results are shown in Table C-10.

TABLE C-10

| | Example C-6 | | | | | |
|---|---|---|---|---|---|---|
| Electro-photographic photosensitive member number | C-6A | C-6B | C-6C | C-6D | C-6E | C-6F |
| Thickness of upper blocking layer (μm) | 0.001 | 0.005 | 0.01 | 0.1 | 1 | 2 |
| Ratio of thickness of upper blocking layer to diameter of largest spherical protrusion | $1 \times 10^{-5}$ | $5 \times 10^{-5}$ | $1 \times 10^{-4}$ | $1 \times 10^{-3}$ | $1 \times 10^{-2}$ | $2 \times 10^{-2}$ |
| Evaluation | | | | | | |
| Number of spherical protrusions | C | C | C | C | C | C |
| Image defects (number of spot) | C | C | B | B | B | B |
| Charge capability | B | B | A | A | A | A |
| Remaining potential | B | B | A | A | A | A |

As apparent from Table C-10, the thickness of the upper blocking layer is preferably $10^{-4}$ times or more as large as the diameter of the largest spherical protrusion for achieving the black spot reduction effect of the present invention. Furthermore, for the photosensitive member C-6F, the black spot reduction effect could be sufficiently achieved, but the thickness of the upper blocking layer was so large that the sensitivity was reduced. Thus, it can be understood that the upper limit of the thickness is desirably 1 μm or less. Furthermore, adhesion properties were improved by washing the photosensitive member by a water washing apparatus before forming thereon the second layer.

Example C-7

The a-Si photosensitive member forming apparatus of RF plasma CVD system shown in FIG. 5 was used to form an electrophotographic photosensitive member having as a first layer a lower blocking layer constituted by a non-single crystal material, a photoconductive layer constituted by a non-single crystal material, and a silicon carbide layer constituted by a non-single crystal material containing carbon and silica, formed on a cylindrical Al substrate with the outer diameter of 108 mm under conditions shown in Table C-11.

TABLE C-11

| | First layer | | | Second layer | | |
|---|---|---|---|---|---|---|
| Gas type and flow rate | Lower blocking layer | Photo-conductive layer | Silicon carbide layer | Intermediate layer | Upper blocking layer | Surface layer |
| $SiH_4$ [ml/min (normal)] | 100 | 300 | 65 | 70 | 100 | — |
| $B_2H_6$ [ppm] (vs. $SiH_4$) | — | — | — | — | Change | — |
| $PH_3$ [ppm] (vs. $SiH_4$) | 750 | 1.5 | — | — | — | — |
| NO [ml/min (normal)] | 5.0 | — | — | — | — | — |
| $CH_4$ [ml/min (normal)] | — | — | 130 | 140 | 500 | 1100 |
| Substrate temperature [° C.] | 260 | 250 | 190 | 180 | 220 | 110 |
| Pressure in reactive vessel [Pa] | 76 | 76 | 76 | 76 | 76 | 76 |
| High frequency power [W] | 150 | 500 | 520 | 550 | 230 | 1400 |
| Film thickness [μm] | 3 | 25 | 0.3 | 0.3 | 0.3 | 0.5 |

Then, a leak valve was opened to introduce atmospheric air into a film forming apparatus while the substrate with the first layer formed thereon was left in the film forming apparatus. In this way, the substrate was exposed to atmospheric air and left standing for 10 minutes, and thereafter the substrate was taken out from the film forming apparatus, and was washed by the water washing apparatus shown in FIG. 8.

After the substrate was washed, the electrophotographic photosensitive member was returned to the film forming apparatus where the first layer had been formed, followed by forming an electrophotographic photosensitive member having an a-Si based intermediate layer formed as a second layer on the first layer and an upper blocking layer constituted by a non-single crystal material formed on the intermediate layer.

A surface layer constituted by a non-single crystal material having carbon atoms as a base material was formed on the upper blocking layer.

Furthermore, in this Example, photosensitive members C-7G to C-7L having the contents of B (boron) being an impurity atom of Group 13 contained in the upper blocking layer were formed.

The negative charging electrophotographic photosensitive member obtained according to the procedure described above was evaluated in the same manner as the evaluation method in Example C-1.

After evaluations were made, each photosensitive member was cut to expose a section to carry out a SIMS analysis (secondary ion mass spectrometry), thereby measuring the content of $B_2H_6$ (boron) in the upper blocking layer. The results are shown in Table C-12.

TABLE C-12

| | Example C-7 | | | | | |
|---|---|---|---|---|---|---|
| Electro-photographic photosensitive member number | C-7G | C-7H | C-7I | C-7J | C-7K | C-7L |
| Content of $B_2H_6$ in upper blocking layer (ppm) | 80 | 100 | 1000 | 10000 | 30000 | 35000 |
| Evaluation | | | | | | |
| Number of spherical protrusions | C | C | C | C | C | C |
| Image defects | C | B | B | B | B | C |
| Charge capability | C | A | A | A | A | C |
| Remaining potential | C | A | A | A | A | C |

As apparent from Table C-12, the content of impurities in the upper blocking layer is preferably 100 ppm to 30,000 ppm.

Example C-8

The a-Si photosensitive member forming apparatus of RF plasma CVD system shown in FIG. 5 was used to form an electrophotographic photosensitive member having as a first layer a lower blocking layer constituted by a non-single crystal material, a photoconductive layer constituted by a non-single crystal material, and a silicon carbide layer constituted by a non-single crystal material containing carbon and silica, formed on a cylindrical Al substrate with the outer diameter of 108 mm under conditions shown in Table C-13.

TABLE C-13

| | First layer | | | Second layer | | |
|---|---|---|---|---|---|---|
| Gas type and flow rate | Lower blocking layer | Photo-conductive layer | Silicon carbide layer | Intermediate layer | Upper blocking layer | Surface layer |
| $SiH_4$ [ml/min (normal)] | 200 | 200 | 55 | 70 | 150 | — |
| $B_2H_6$ [ppm] (vs. $SiH_4$) | — | — | Change | — | 3000 | — |
| $PH_3$ [ppm] (vs. $SiH_4$) | 1500 | 1.0 | — | — | — | — |
| NO [ml/min (normal)] | 10 | — | — | — | — | — |
| $CH_4$ [ml/min (normal)] | — | — | 110 | 140 | 150 | 1000 |
| Substrate temperature [° C.] | 240 | 220 | 230 | 180 | 240 | 90 |
| Pressure in reactive vessel [Pa] | 76 | 76 | 76 | 76 | 76 | 76 |
| High frequency power [W] | 110 | 500 | 620 | 550 | 310 | 1200 |
| Film thickness [μm] | 3 | 25 | 0.3 | 0.3 | 0.5 | 0.5 |

Then, the substrate with the first layer formed thereon was temporarily taken out from a film forming apparatus and exposed to atmospheric air. The substrate was left standing in an atmospheric air for 10 minutes, and thereafter the polishing apparatus shown in FIG. 7 was used to polish the surface to flatten projection portions of spherical protrusions. The sizes of irregularities on the surface before being polished were 10 μm or greater, by they were reduced to 1 μm by this flattening process.

Irregularities of protrusions were evaluated with a difference between Z1 and Z2, in which the position when the top of the protrusion was brought into focus was defined as Z1, and the position when a nearby normal area was brought into focus was defined as Z2, using a microscope with a Z direction (far-and-near direction of subject and objective lens) position sensing function (STM-5 manufactured by Olympus Co., Ltd.). Then, the water washing apparatus shown in FIG. 8 was used to wash the surface.

Thereafter, the electrophotographic photosensitive member with the first layer formed thereon was returned to the film forming apparatus to form an intermediate layer and upper blocking layer constituted by a non-single crystal material as a second layer on the first layer polished.

Then, a surface layer constituted by a non-single crystal material having carbon atoms as a base material was formed on the upper blocking layer.

Furthermore, in this Example, photosensitive members C-8M to C-8R having the contents of B (boron) being an impurity atom of Group 13 contained in the silicon carbide layer were formed.

The negative charging electrophotographic photosensitive member obtained according to the procedure described above was evaluated in the same manner as the evaluation method in Example C-1.

After evaluations were made, each photosensitive member was cut to expose a section to carry out a SIMS analysis (secondary ion mass spectrometry), thereby measuring the content of $B_2H_6$ (boron) in the silicon carbide layer. The results are shown in Table C-14.

TABLE C-14

| | Example C-8 | | | | | |
|---|---|---|---|---|---|---|
| Electro-photographic photosensitive member number | C-8M | C-8N | C-8O | C-8P | C-8Q | C-8R |
| Content of $B_2H_6$ in silicon carbide layer (ppm) | 80 | 100 | 1000 | 10000 | 30000 | 35000 |
| Evaluation | | | | | | |
| Number of spherical protrusions | C | C | C | C | C | C |
| Image defects | C | B | B | B | B | C |
| Charge capability | A | AA | AA | AA | AA | A |
| Remaining potential | A | A | A | A | A | A |

As apparent from Table C-14, the charge capability is remarkably improved by incorporating the impurities in the content of 100 ppm to 30,000 ppm into the silicon carbide layer.

Example D-1

The RF plasma a-Si photosensitive member forming apparatus shown in FIG. 5 was used to produce one substrate with the first layer formed on an Al substrate with the diameter of 108 mm under conditions shown in Table D-1.

TABLE D-1

| Gas type and flow rate | Lower blocking layer | Photo-conductive layer | Intermediate layer (silicon carbide layer) |
|---|---|---|---|
| $SiH_4$ [ml/min (normal)] | 110 | 200 | 12 |
| $H_2$ [ml/min (normal)] | 400 | 800 | — |
| $B_2H_6$ [ppm] (vs. $SiH_4$) | 3000 | 0.2 | — |
| NO [ml/min (normal)] | 6 | — | — |
| $CH_4$ [ml/min (normal)] | — | — | 650 |
| Substrate temperature {° C.} | 260 | 260 | 260 |
| Pressure in reaction vessel {Pa} | 64 | 79 | 60 |
| High frequency power {w} | 120 | 500 | 200 |
| Film thickness {μm} | 3 | 30 | 0.3 |

Then, one substrate with the first layer formed thereon was temporarily taken out from a film forming apparatus and exposed to atmospheric air. The arithmetic average roughness Ra of the outermost surface of the first layer was measured immediately after the substrate was taken out from the film forming apparatus. The measurement was carried out using an interatomic force microscope (AFM) [Q-Scope 250 manufactured by Quesant Co., Ltd.]. As a result, the arithmetic average roughness Ra of outermost surface of the first layer was 42 nm in the visual field of 10 μm×10 μm. Then, the outermost surface of the formed first layer was processed.

For the surface processing, the surface was polished by applying a pressure of 0.1 MPa to a wrapping tape with the width of 360 mm (trade name: C2000) manufactured by Fuji Photo Film Co., Ltd. with a press roller of JIS rubber hardness 30 under conditions of tape speed of 3.0 mm/min and photosensitive member rotation speed of 60 rpm.

As a result, the arithmetic average roughness Ra of the surface was 12 nm in the visual field of 10 μm×10 μm. Then, the photosensitive member subjected to the surface processing was returned to the RF plasma a-Si photosensitive member forming oven shown in FIG. 5 to form a surface protection layer as a second layer under conditions shown in FIG. 5.

TABLE D-2

| Gas type and flow rate | Surface protection layer |
|---|---|
| $SiH_4$ [ml/min (normal)] | 12 |
| $CH_4$ [ml/min (normal)] | 650 |
| Substrate temperature {° C.} | 210 |
| Pressure in reaction vessel {Pa} | 60 |
| High frequency power {W} | 200 |
| Film thickness {μm} | 0.8 |

One more photosensitive member was fabricated in the same manner except that the Ra of the processed surface was 25 nm.

The photosensitive member fabricated according to the procedure described above is a photosensitive member for use in positive charge, and it was evaluated using iR 8500 manufactured by Canon Inc. The results of evaluation for image defects were rated in relative comparison with the value in Example D-2 defined as 100%. The results are shown in Table D-3.

Example D-2

The RF plasma a-Si photosensitive member forming apparatus shown in FIG. 5 was used to produce one substrate with the first layer formed on an Al substrate with the diameter of 108 mm under conditions shown in Table D-1. Then, the substrate with the first layer formed thereon was temporarily taken out from a film forming apparatus, and the arithmetic average roughness Ra of the outermost surface of the first layer was measured immediately after the substrate was taken out from the film forming apparatus. The measurement was carried out in the same manner as Example D-1. As a result, the arithmetic average roughness Ra was 41 nm. Then, the substrate was returned to the RF plasma a-Si photosensitive member forming oven shown in FIG. 5 without carrying out surface processing, and a surface protection layer as a second layer was formed under conditions shown in D-2.

The obtained photosensitive member was evaluated as follows.

Image Defects

A corona discharging device was employed as a primary charging device, and the electrophotographic photosensitive member fabricated in this Example was installed in an electrophotographic apparatus having a cleaning blade in a cleaner to form images. Specifically, iR 8500 manufactured by Canon Inc. was used as a test electrophotographic apparatus to copy A3 size plain white originals. The image obtained in this way was observed to count the number of black spots caused by spherical protrusions having diameters of 0.1 mm or greater.

The obtained results were rated in relative comparison with the value in Example D-2 defined as 100%.

A: Equal to or greater than 35% and less than 65%.

B: Equal to or greater than 65% and less than 95%.

C: Equivalent to Example D-2.

Evaluation of Adhesion Properties

Observation of Peeling

The fabricated electrophotographic photosensitive member is left standing for 48 hours in a container adjusted to have a temperature of −30° C., and is immediately thereafter left standing for 48 hours in a container adjusted to have a temperature of +50° C. and a humidity of 95%. After the heat shock test in which the above cycle was repeated ten times, the surface of the electrophotographic photosensitive member was observed. After the vibration test in which a vibration of 10 Hz to 10 kHz having an acceleration of 7G was created repeatedly in 5 cycles with the sweep time of 2.2 minutes, the surface of the electrophotographic photosensitive member was observed. Evaluations were made in accordance with the following criteria.

A: Excellent with no peeling found after the vibration test.

B: A very small scale of peeling partially occurs in an end of a non-image area, but no problem arises practically.

C: Equivalent to Example D-2.

Evaluation of Cleaning Performance

Slip-through of Toner

The iR 8500 described above was used to make evaluations on slip-through of a toner. A 100,000-sheet continuous paper feed running test was carried out using a specified paper of A3-size as an original. After the durability test, a halftone image was copied to check existence/nonexistence of slip-through of the toner. Specifically, in the halftone image of A3 size, an area soiled due to the slip-through of the toner was estimated from five copy samples. The same test was carried out five times to obtain a result with five copy samples.

Determination criteria are as follows.

A: No soiling.

B: Almost no soiling.

C: Equivalent to Example D-2.

Damage of Cleaning Blade Edge

The electrophotographic photosensitive member fabricated in this Example was installed in the modified iR 8500 to carry out a 5,000,000-sheet continuous paper feed running test, and the damaged (chipped or scratched) state of the edge of a cleaning blade after completion of the durability test was examined.

A: No damage is found and the state is quite excellent.

B: Excellent.

C: Equivalent to Example D-2.

The results in Examples D-1 and D-2 are shown in Table D-3. As apparent from Table D-3, an effect of reducing image defects could be achieved by subjecting the outermost surface of the first layer to processing so that its Ra was 25 nm. Furthermore, it is found from the results of observation on peeling that the photosensitive member of Example D-1 is excellent in adhesion properties. Furthermore, it was clearly shown that the photosensitive member of Example D-1 is quite excellent in cleaning performance from the results for slip-through of the toner and damage of the cleaning blade. Furthermore, no interference patterns occurred, resulting in high quality images.

TABLE D-3

| Ra of surface of | Example D-1 | | Example D-2 |
|---|---|---|---|
| first layer | 12 nm | 25 nm | 41 nm |
| Evaluation | | | |
| Image defects | A | B | C |
| Observation of peeling | B | B | C |
| Slip-through of toner | A | B | B |
| Damage of blade edge | A | B | B |

What is claimed is:

1. A method for producing an electrophotographic photosensitive member including layers each constituted by a non-single crystal material, comprising the steps of:

placing a substrate having a conductive surface in a film forming apparatus capable of being airtight-sealed under vacuum comprising evacuating means and raw material gas supplying means, and decomposing at least a raw material gas by a high frequency power to form a first layer constituted by at least a non-single crystal material on the substrate as a first step;

exposing the substrate with the first layer formed thereon to a gas containing oxygen and water vapor as a second step; and decomposing at least a raw material gas by a high frequency power in said film forming apparatus to form on the first layer a second layer including an upper blocking layer constituted by a non-single crystal material as a third step.

2. The method according to claim 1, wherein said gas containing oxygen and water vapor is atmospheric air.

3. The method according to claim 2, wherein in said second step, the substrate with said first layer formed thereon is temporarily taken out from said film forming apparatus and thereby exposed to atmospheric air.

4. The method according to claim 1, wherein said first layer is constituted by a non-single crystal material having at least silicon atoms as a base material and containing hydrogen atoms and/or a halogen.

5. The method according to claim 1, wherein the step of forming said first layer include forming at least a photoconductive layer and a silicon carbide layer.

6. The method according to claim 5, wherein an element of Group 13 or Group 15 of the periodic table is incorporated in said silicon carbide layer.

7. The method according to claim 6, wherein the content of said element of Group 13 or Group 15 of the periodic table is from 100 atomic ppm to 30,000 atomic ppm.

8. The method according to claim 1, wherein said upper blocking layer is constituted by a non-single crystal material having at least silicon atoms as a base material and containing at least one of carbon, oxygen and nitrogen atoms.

9. The method according to claim 8, wherein said upper blocking layer is constituted by a non-single crystal material further containing impurity atoms for controlling a conductivity.

10. The method according to claim 9, wherein said impurity atom contained in said upper blocking layer for controlling a conductivity is an element of Group 13 or Group 15 of the periodic table.

11. The method according to claim 10, wherein the content of said element of Group 13 or Group 15 of the periodic table contained in said upper blocking layer is from 100 atomic ppm to 30,000 atomic ppm.

12. The method according to claim 1, wherein said upper blocking layer is formed so that the thickness of said upper blocking layer $10^{-4}$ times or more as large as the largest one of spherical protrusions existing on the surface of said electrophotographic photosensitive member with the second layer formed thereon and equal to or less than 1 μm.

13. The method according to claim 1, wherein said third step includes a step of further forming a surface layer on said upper blocking layer.

14. The method according to claim 13, wherein said surface layer is constituted by a non-single crystal material having at least silicon atoms as a base material and further containing at least one of carbon, oxygen and nitrogen atoms.

15. The method according to claim 13, wherein said surface layer is constituted by a non-single crystal material having carbon atoms as a base material.

16. The method according to claim 15, wherein the substrate temperature when said surface layer is formed is lower than the substrate temperature when said upper blocking layer is formed.

17. The method according to claim 1, wherein said second step further includes a step of processing the surface of said first layer.

18. The method according to claim 17, wherein the step of processing the surface of said first layer is a step of removing at least head portions of protrusions existing on the surface of the first layer formed in said first step.

19. The method according to claim 17, wherein the step of processing the surface of said first layer is a step of carrying out polishing processing.

20. The method according to claim 19, wherein said polishing processing is polishing protrusions on the surface of said first layer formed in said first step to flatten the surface.

21. The method according to claim 19, wherein said polishing processing is performed by abutting a polishing tape against the surface of said first layer formed in said first step using an elastic rubber roller, and providing a relative difference between the traveling speed of the surface of said first layer made to travel with said substrate and the rotation speed of the elastic rubber roller abutting said polishing tape against the surface of said first layer.

22. The method according to claim 17, wherein the step of processing the surface of said first layer is performed so that the arithmetic average roughness (Ra) measured in the visual field of 10 μm×10 μm is 25 nm or less.

23. The method according to claim 1, wherein said second step further includes a step of inspecting the photosensitive member with said first layer formed thereon.

24. The method according to claim 1, wherein in said second step, the surface of said first layer is made to contact water to wash the same before proceeding to said third step.

25. An electrophotographic photosensitive member produced by the production method according to claim 1.

26. An electrophotographic apparatus using the electrophotographic photosensitive member of claim 25.

* * * * *

UNITED STATES PATENT AND TRADEMARK OFFICE

CERTIFICATE OF CORRECTION

PATENT NO. : 7,033,721 B2
APPLICATION NO. : 10/630727
DATED : April 25, 2006
INVENTOR(S) : Junichiro Hashizume et al.

It is certified that error appears in the above-identified patent and that said Letters Patent is hereby corrected as shown below:

COLUMN 1:
Line 29, "to" should be deleted.

COLUMN 6:
Line 42, "to" (2nd occurrence) should be deleted.

COLUMN 8:
Line 2, "occur" should read --occurs--.

COLUMN 13:
Line 38, "entirely" should read --entire--.

COLUMN 14:
Line 9, "is" should read --its--.

COLUMN 16:
Line 20, "can" should read --can be--.
Line 44, "becomes" should read --become--.

COLUMN 17:
Line 29, "scares" should read --scars--.
Line 41, "transparence" should read --transparency--.

COLUMN 32:
Line 47, "obtain" should read --obtained--.

COLUMN 48:
Line 41, "weak," should read --week,--.

COLUMN 52:
Line 24, "scares," should read --scars,--.

COLUMN 54:
Line 37, "Scares" should read --Scars--.
Line 46, "Scares" should read --Scars--.
Line 48, "Scares" should read --Scars--.
Table C-8, "Scares" should read --Scars--.

UNITED STATES PATENT AND TRADEMARK OFFICE

CERTIFICATE OF CORRECTION

PATENT NO. : 7,033,721 B2
APPLICATION NO. : 10/630727
DATED : April 25, 2006
INVENTOR(S) : Junichiro Hashizume et al.

It is certified that error appears in the above-identified patent and that said Letters Patent is hereby corrected as shown below:

COLUMN 55:
Table C-8, "Scares" should read --Scars--.
Line 17, "Scares" should read --Scars--.

COLUMN 61:
Line 1, "by" should read --but--.

Signed and Sealed this

Fifth Day of December, 2006

JON W. DUDAS
*Director of the United States Patent and Trademark Office*